US007031229B2

(12) United States Patent
Tanifuji

(10) Patent No.: US 7,031,229 B2
(45) Date of Patent: Apr. 18, 2006

(54) ELECTRONIC TIMEPIECE AND DISPLAY SWITCHING METHOD AND DISPLAY SWITCHING PROGRAM FOR ELECTRONIC TIMEPIECE

(75) Inventor: Norio Tanifuji, Chiba (JP)

(73) Assignee: Seiko Instruments Inc., Chiba (JP)

( * ) Notice: Subject to any disclaimer, the term of this patent is extended or adjusted under 35 U.S.C. 154(b) by 431 days.

(21) Appl. No.: 10/147,414

(22) Filed: May 16, 2002

(65) Prior Publication Data

US 2002/0181331 A1 Dec. 5, 2002

(30) Foreign Application Priority Data

May 29, 2001 (JP) ..... 2001-160851

(51) Int. Cl.
*G04C 19/00* (2006.01)

(52) U.S. Cl. ..... 368/82; 368/223

(58) Field of Classification Search ..... 368/10, 368/80, 82–84, 111, 121, 223, 224, 242; 702/178; 340/309.16

See application file for complete search history.

(56) References Cited

U.S. PATENT DOCUMENTS

| | | | | |
|---|---|---|---|---|
| 4,841,454 | A | 6/1989 | Awazu | |
| 5,088,070 | A * | 2/1992 | Shiff | 368/10 |
| 5,477,508 | A * | 12/1995 | Will | 368/189 |
| 6,201,526 | B1 | 3/2001 | Burgan | |
| 6,611,476 | B1 * | 8/2003 | Obasawa et al. | 368/82 |

FOREIGN PATENT DOCUMENTS

EP 1048992 2/2000

* cited by examiner

*Primary Examiner*—Kamand Cuneo
*Assistant Examiner*—Thanh S. Phan
(74) *Attorney, Agent, or Firm*—Adams & Wilks

(57) ABSTRACT

An electronic timepiece has a computer for controlling operation of the electronic timepiece. The computer stores in a storage medium data inputted by a user using functions of the electronic timepiece. A display time of the data is switched by the computer in accordance with an amount of the data stored in the storage medium. The computer then displays the data on a screen of the electronic timepiece by successively switching display of the data in accordance with the switched display time.

20 Claims, 18 Drawing Sheets

| NO.OF MEMORY | TIME(SECOND) |
|---|---|
| 1~9 | 3.0 |
| 10~20 | 2.5 |
| 21~30 | 2.0 |
| 31~40 | 1.5 |
| 41~50 | 1.0 |
| 51~ | 0.5 |

ELECTRONIC TIMEPIECE AND DISPLAY SWITCHING METHOD AND DISPLAY SWITCHING PROGRAM FOR ELECTRONIC TIMEPIECE

BACKGROUND OF THE INVENTION

1. Field of the Invention

The present invention relates to a display switching method for an electronic timepiece, an electronic timepiece, and a display switching program for the electronic timepiece and, more specifically, relates to a method of switching a display of a screen of the electronic timepiece in accordance with an amount of data in a state of ensuring optical recognizability of a user, and particularly to technology useful for displaying in the case of a large amount of data such as measured lap time.

2. Description of the Prior Art

Generally, portable type electronic apparatuses have been designed to be small-sized and light-weighted and to have multiple functions. For example, a portable type electronic timepiece in the form of a wrist watch is provided with an additional function other than an inherent timepiece function. As such an additional function, there is a lap measuring function used for measuring lap time by an athlete or the like, or an altimeter function used for measuring an altitude by a climber or the like.

Furthermore, a display of the electronic timepiece is formed with a necessary minimum size corresponding to the small-sized and light-weighted structure of the electronic timepiece. Therefore, the display is constituted by a size for making a user optically recognize time, which is an inherent timepiece function. The size is a size sufficient for making a user optically recognize when, for example, time "12:00" or the like is displayed substantially by a full screen. Further, according to an electronic timepiece of this kind, it is known to display lap time, an altitude value of the like (hereinafter, referred to as "lap time or the like") also by a size of display similar to that for displaying time.

Therefore, when there are a plurality of measured lap times, by successively reading lap time or the like from a memory by a CPU or an electronic timepiece and switching a screen at constant intervals, the measured lap time or the like is successively displayed. Further, display start timing or the like is measured generally when a user depresses a lap display button provided at an exterior of an electronic timepiece.

FIG. 19 shows a transitional change of a display screen for explaining a display switch timing of a conventional electronic timepiece. As shown by FIG. 19, lap time is displayed by a full display screen and is set to switch to successive data at an interval of 3 seconds.

Further, in reading data of lap time or the like from a memory of the CPU, by designating either one of a push down stack and a push up stack, it can be selected whether display is executed from the newest lap time or display is executed from the oldest lap time.

However, according to the above-described conventional electronic timepiece, the screen is switched at constant intervals and, therefore, there poses a problem that a lot of time is required for displaying, for example, all of measured lap time which is inconvenient to the user. Further, when an interval between timings of switching a screen is uniformly set to a short time period, since the switching process is fast, there poses a problem that data is liable to be overlooked and that all of the data cannot be recognized optically.

SUMMARY OF THE INVENTION

Hence, the invention has been carried out in view of the above-described problems in the conventional art, and it is an object thereof to provide a display switching method of an electronic timepiece for improving its use by a user by switching a display screen in accordance with an amount of data in a state of ensuring optical recognizability by the user, and to an electronic timepiece and a display switching program for the electronic timepiece.

In order to achieve the above-described object, according to the invention, there is provided a method of switching a display of an electronic timepiece including a data storing step of storing data inputted using functions of an electronic timepiece by a user to a storage medium capable of being read by a computer for controlling the electronic timepiece using the computer, a switching step of switching display time of the in accordance with an amount of the data stored in the storage medium by the computer, and a displaying step of displaying the data on a screen by successively switching display of the data in accordance with the switched display time by the computer.

Thereby, the display can be switched in accordance with the amount of the data and, therefore, there can be provided a display switching method of an electronic timepiece improving a way of use by a user by switching to display the screen in accordance with the amount of the data in a state of ensuring optical recognizability by the user even in the case of a large amount of the data as in measured lap time, an electronic timepiece, and a display switching program for the electronic timepiece.

Here, lap time data, altitude value data, temperature data and the like can be used as the data (hereinafter referred to "various data") inputted by using various functions of the electronic timepiece. The electronic timepiece needs to be provided with a lap time measuring function, an altimeter function, a thermometer function and the like to provide such data. The lap time measuring function, the altimeter function and the thermometer function can be realized by executing programs by the computer for controlling the electronic timepiece. Incidentally, in the case of the lap time measuring function, there is needed a lap button for instructing an interval of measurement by the user. In the case of the altimeter function, it is necessary to calculate an altitude from atmospheric pressure by providing a pressure detecting sensor and detecting a change in the atmospheric pressure in accordance with the altitude. Further, in the case of the thermometer function, a temperature detecting sensor is needed.

According to the next invention, there is provided the method of switching display of an electronic timepiece further including a reference value storing step of setting a reference value of the amount of the various data and previously storing the reference value to the storage medium by the computer, wherein in the switching step, the computer switches the display time by whether the amount of the various data is larger or smaller than the reference value as a characteristic in view of a processing thereof.

Thereby, the display is switched in accordance with the reference value and therefore, for example, when the amount of the various data is larger than the reference value, by switching the display to shorten the display time of the various data, total display time of the various data can be shortened.

According to the next invention, there is provided the method of switching display of an electronic timepiece further including a display time storing step of storing the display time having at least two stages and reference display time constituting a reference in the display time to the storage medium by the computer, a reference total display time calculating step of calculating reference total display time when the acquired various data is displayed to switch by the reference display time by the computer from a relationship between the amount of the acquired various data and the reference display time, a total display time comparing step of comparing the reference total display time and longest total display time by the computer, and an actual display time setting step of setting the reference display time as actual display time by the computer when the reference total display time is shorter than the longest total display time and selecting display time by which the reference total display time becomes shorter than the longest total display time when the reference total display time is longer than the longest total display time and setting the display time as the actual display time by the computer, wherein in the switching step, the computer switches to display the various data to the screen by the set actual display time as a characteristic in view of a processing thereof.

Thereby, even in the case of a large amount of the various data, when the total display time is long, the display time can be switched to shorten the total display time and therefore, a user can execute confirming operation during a constant time period (longest total display time).

According to the next invention, there is provided the method of switching display of an electronic timepiece further including a display time storing step of storing the display time having at least two stages, reference display time constituting a reference in the display time and longest total display time for making total time of displaying the various data on the screen longest, in the storage medium by the computer, a data type or kind name storing step of storing a the type or kind name of data displayed with a priority in the acquired various data to the storage medium by the computer, a reference total display time calculating step of calculating reference total display time when the acquired various data is displayed to switch by the reference display time from a relationship between the amount of the acquired various data and the reference display time by the computer, a total display time comparing step of comparing the reference total display time and the longest total display time by the computer, and a picking-up step of picking up data of a previously set kind name from the acquired various data by the computer when the reference total display time is longer than the longest total display time, wherein in the switching step, the computer successively displays the picked-up data, as a characteristic in view of a processing thereof.

Thereby, in the case of the large amount of various data, the display time can be switched to display the data of the kind name of the data displayed with priority among the acquired various data by giving priority thereto within a constant time period (longest total display time) and therefore, a user can execute confirming operation by giving the priority to the data of the kind name of the data displayed with the priority among the acquired various data during the constant time period (longest total display time).

According to the next invention, there is provided the method of switching display of an electronic timepiece wherein in the kind name storing step, the kind name of the data displayed with the priority in the acquired various data is stored to the storage medium as newest data, wherein in the picking-up step, the data is picked up successively from a newest one of the acquired data, and wherein in the displaying step, the data is displayed successively from the newest one of the picked-up data. Thereby, the newest data can be displayed with priority.

According to the next invention, there is provided the method of switching display of an electronic timepiece wherein in the kind name storing step, the computer stores a number of set data to be picked up to the storage medium, wherein in the picking-up step, the computer picks up an amount of the number of the set data, and wherein in the displaying step, the computer displays successively data of the amount of the number of the picked-up set data as a characteristic in view of a processing thereof. Thereby, in the case of the large amount of the various data, only the number of the set necessary data can be displayed with priority.

According to the next invention, there is provided the method of switching display of an electronic timepiece wherein in the reference total display time calculating step, the reference total display time is calculated by calculating a product of the amount of the various data by the reference display time, or a relationship among the amount of the various data, the reference display time and the product of the amount of the various data by the reference display time is stored previously to the storage medium capable of being read by the computer as a data base, and wherein the computer calculates a corresponding one of the reference total display time from the data base in accordance with the relationship between the amount of the various data and the reference display time as a characteristic in view of a processing thereof. Thereby, the reference total display time can specifically be calculated.

According to the next invention, there is provided the method of switching display of an electronic timepiece including display time storing step of storing display switch setting time prolonging display time of data of kind name of data displayed with priority among the acquired various data and shortening display time of data other than the kind name of the data displayed with priority among the acquired various data, to the computer readable storage medium and in the displaying step, display time is prolonged in the case of the data of the kind name of the data displayed with priority among the acquired various data and the display time is shortened in the case of data other than the kind name of the data displayed with priority among the acquired various data to thereby attach intensity in display timing as a characteristic in view of a processing thereof. Thereby, a user can look at the data of the kind name of the data displayed with priority among the acquired various data with caution and can look at the other data to a degree of swiftly recognizing the other data.

According to the next invention, there is provided the method of switching display of an electronic timepiece wherein in the displaying step, the computer displays the various data from a first one in an order of acquiring the various data in accordance with the switched display time, or displays the various data successively from a last one as a characteristic in view of a processing thereof. Thereby, since the acquired data is displayed successively from the first or the last and therefore, a user can recognize the data from the first or the last as necessary.

According to the next invention, there is provided the method of switching display of an electronic timepiece wherein in the switching step, the computer switches the display screen by prolonging or shortening the display time of the respective various data, or switches the display screen by attaching an intensity to the display time by changing a length of the display time for respective various data as a characteristic in view of a processing thereof. Thereby, a user is easy to recognize the various data for paying attention as necessary.

According to the next invention, there is provided the method of switching display of an electronic timepiece wherein in the switching step, the computer sets to switch the display by selecting only predetermined data as a characteristic in view of a processing thereof. Thereby, a user can selectively recognize the predetermined data.

According to the next invention, there is provided the method of switching display of an electronic timepiece, wherein the predetermined data is constituted by data of a kind previously set and which includes a searching and sampling step of searching and sampling the data of the set kind, as a characteristic in view of a processing thereof. Thereby, a user can recognize only necessary data by setting the kind of the necessary data of the user per se.

According to the next invention, there is provided the method of switching display of an electronic timepiece including a priority storing step of setting a priority to a kind of set various data and storing the priority to the storage medium by the computer and in the displaying step, the computer displays the various data in accordance with the priority as a characteristic in view of a processing thereof. Thereby, the user can recognize with priority necessary data in accordance with the priority.

According to the next invention, there is provided the method of switching display of an electronic timepiece wherein the computer executes at least one step of a light emitting step of making a light emitting element emit light, a sound outputting step of outputting sound, or a vibrating step of vibrating the electronic timepiece along with the displaying step as a characteristic in view of a processing thereof. Thereby, since light emittance, sound or vibration is outputted in displaying the various data, the user is easy to pay attention to consciousness for the screen. Further, in the light emitting step, a light emitting element for emitting light may be constituted by, for example, a backlight of display or illumination light. Further, in the sound outputting step, outputted sound may be, for example, buzzer sound.

According to the next invention, there is provided the method of switching display of an electronic timepiece providing a button having two functions of a function of instructing the computer to execute the light emitting step and a function of instructing the computer to execute the displaying step, wherein when a user depresses the button with an intention of display, the computer executes the light emitting step along with the displaying step as a characteristic in view of a processing thereof. Thereby, when the user intends to display the various data, the button is depressed and therefore, light is emitted along with the display and a user can be further expedited to pay attention for confirming the display.

According to the next invention, there is provided the method of switching display of an electronic timepiece further including a depression recognizing step of recognizing depression of a commanding button provided to the electronic timepiece by the computer, wherein in the switching step, when the computer recognizes the depression of the commanding button, the computer switches the display time as a characteristic in view of a processing thereof. Thereby, in displaying the various data as necessary, a user can change the display time by depressing the commanding button and therefore, for example, the display is fastly switched in the case of unnecessary data and only necessary data can be confirmed by slowly displaying necessary data selectively.

According to the next invention, there is provided the method of switching display of an electronic timepiece in which in the switching step, the computer fixes the screen of data displayed in depressing the commanding button for a constant time period and after elapse of the constant time period, the data is switched to successive data as a characteristic in view of a processing thereof. Thereby, a user can recognize necessary data selectively by fixing the display.

According to the next invention, there is provided the method of switching display of an electronic timepiece, wherein in the switching step, the computer executes the switching operation by prolonging, shortening or attaching intensity to the display time for respective various data during elapse of the constant time period after depressing the commanding button as a characteristic in view of a processing thereof. Thereby, a user is easy to recognize data which the user intends to confirm with caution.

According to the next invention, there is provided the method of switching display of an electronic timepiece, wherein in the switching step, the computer returns to switching of display before depressing the commanding button after elapse of the constant time period after depressing the commanding button as a characteristic in view of a processing thereof. Thereby, it is possible that the user searches necessary data by successively displaying the various data and confirms necessary data by depressing the commanding button and thereafter searches necessary data again.

Further, according to the next invention, there is provided an electronic timepiece comprising various data storing means for storing various data inputted by using various functions by a user to a storage medium capable of being read by a computer, switching means for switching display time of the various data in accordance with an amount of the various data stored to the storage medium, and displaying means for displaying the various data by successively switching to display the various data on a screen in accordance with the switched display time, as a characteristic in view of a constitution thereof.

According to the next invention, there is provided the electronic timepiece including a reference value storing means of setting a reference value of the amount of the various data and previously storing the reference value to the storage medium by the computer, wherein in the switching means, the computer switches the display time by whether the amount of the various data is larger or smaller than the reference value, as a characteristic in view of a constitution thereof.

According to the next invention, there is provided the electronic timepiece further including, a display time storing means of storing the display time having at least two stages and reference display time constituting a reference in the display time to the storage medium, a reference total display time calculating means of calculating reference total display time when the acquired various data is displayed to switch by the reference display time from a relationship between the amount of the acquired various data and the reference display time, a total display time comparing means of comparing the reference total display time and longest total display time, and an actual display time setting means of setting the reference display time as actual display time when the reference total display time is shorter than the longest total display time and selecting display time by which the reference total display time becomes shorter than the longest total display time when the reference total display time is longer than the longest total display time and setting the display time as the actual display time by the computer, wherein in the switching means, the computer switches to display the various data to the screen by the set actual display time, as a characteristic in view of a constitution thereof.

According to the next invention, there is provided the electronic timepiece further including a display time storing means of storing the display time having at least two stages, reference display time constituting a reference in the display time and longest total display time for making total time of displaying the various data on the screen longest, in the storage medium, a kind name storing means of storing a kind name of data displayed with a priority in the acquired various data to the storage medium, a reference total display time calculating step of calculating reference total display time when the acquired various data is displayed to switch by the reference display time from a relationship between the amount of the acquired various data and the reference display time, a total display time comparing means of comparing the reference total display time and the longest total display time, and a picking-up means of picking up data of a kind name of data displayed with priority among the acquired various data previously set from the acquired various data when the reference total display time is longer than the longest total display time, wherein the switching means successively displays the picked-up data displayed with priority among the acquired various data, as a characteristic in view of a constitution thereof.

According to the next invention, there is provided the electronic timepiece wherein the kind name storing means stores the kind name of the data displayed with the priority in the acquired various data to the storage medium as newest data, and picking-up means picks up the data successively from a newest one of the acquired data, and the displaying means displays the data successively from the newest one of the picked-up data, as a characteristic of a constitution thereof.

According to the next invention, there is provided the electronic timepiece wherein the kind name storing means stores a number of set data to be picked up to the storage medium, the picking-up means picks up an amount of the number of the set data, and the displaying means, displays successively data of the amount of the number of the picked-up set data, as a characteristic of a constitution thereof.

According to the next invention, there is provided the electronic timepiece in which the reference total display time calculating means calculates the reference total display time by calculating a product of the amount of the various data by the reference display time, or stores a relationship among the amount of the various data, the reference display time and the product of the amount of the various data by the reference display time previously to the storage medium as a data base, and calculates a corresponding one of the reference total display time from the data base in accordance with the relationship between the amount of the various data and the reference display time, as a characteristic in view of a constitution thereof.

According to the next invention, there is provided the electronic timepiece including display time storing means for storing display switch setting time prolonging display time of data of kind name of data displayed with priority among the acquired various data and shortening display time of data other than the kind name of the data displayed with priority among the acquired various data, to the storage medium and the displaying means prolongs display time in the case of the data of the kind name of the data displayed with priority among the acquired various data and shortens display time in the case of data other than the kind name of the data displayed with priority among the acquired various data to thereby attach intensity in display timing as a characteristic in view of a constitution thereof.

According to the next invention, there is provided the electronic timepiece in which the displaying means displays the various data from a first one in an order of acquiring the various data in accordance with the switched display time, or displays the various data successively from a last one, as a characteristic in view of a processing thereof.

According to the invention, there is provided the electronic timepiece in which the switching means switches the display screen by prolonging or shortening the display time of the respective various data, or switches the display screen by attaching an intensity to the display time by changing a length of the display time for respective various data, as a characteristic in view of a processing thereof.

According to the next invention, there is provided the electronic timepiece in which the switching step sets to switch the display by selecting only predetermined data, as a characteristic in view of a constitution thereof.

According to the next invention, there is provided the electronic timepiece in which the predetermined data is constituted by data of a kind previously set and which is provided with searching and sampling means for searching and sampling data of the set kind in displaying as a characteristic in view of a constitution thereof.

According to the next invention, there is provided the electronic timepiece having the priority storing means for setting priority to the kind of the set various data and storing the priority to the storage medium and the displaying means displays the various data in accordance with the priority as a characteristic in view of a constitution thereof.

According to the next invention, there is provided the electronic timepiece having controlling means for operating at least one means of a light emitting means of making a light emitting element emit light, a sound outputting means of outputting sound, or a vibrating means of vibrating the electronic timepiece along with the displaying means in parallel therewith, as a characteristic in view of a constitution thereof.

According to the next invention there is provided the electronic timepiece providing a button having two functions of a function of the light emitting means and a function of the displaying means, wherein when a user depresses the button with an intention of display, the various data is displayed and the light emitting element emits light, as a characteristic in view of a constitution thereof.

According to the next invention, there is provided the electronic timepiece, further including a depression recognizing means of recognizing depression of a commanding button provided to the electronic timepiece and when the switching means recognizes the depression of the commanding button, the switching means switches the display time as a characteristic in view of a constitution thereof.

According to the next invention, there is provided the electronic timepiece in which the switching means fixes the screen of data displayed in depressing the commanding button for a constant time period and after elapse of the constant time period the data is switched to successive data as a characteristic in view of a constitution thereof.

According to the next invention, there is provided the electronic timepiece in which the switching means switches the display time at respective various data to prolong, shorten or attach intensity during the elapse of the constant time period after depressing the commanding button as a characteristic in view of a constitution.

According to the next invention, there is provided the electronic timepiece in which the switching means returns to switch of display before depressing the commanding button after elapse of the constant time period after depressing the commanding button as a characteristic in view of a constitution thereof. Further, the respective electronic timepiece provides means for realizing the respective display switching method.

Furthermore, according to the next invention, there is provided a program of switching display which is a program for making a computer execute the respective steps of the method of switching display of an electronic timepiece as a characteristic in view of a constitution thereof.

"Program" is a data processing method described by arbitrary language or describing method and there may be used a style of a source code or a binary code or the like. Further, "program" is not necessarily constituted by itself but includes a constitution dispersedly constituted as a plurality of modules or libraries, or a constitution achieving its function in cooperation with a separate program represented by OS (Operating System). Further, with regard to a specific constitution for reading the storage medium in the respective apparatus shown in the embodiments, reading procedure, or, installing procedure after reading or the like, well-known constitutions or procedures can be used.

Further, the "storage medium capable of being read by a computer" in respective claims, includes an arbitrary "physical medium for portable use" such as a floppy disk, a magneto-optical disk, ROM, EPROM, EEPROM, CD-ROM, DVD or the like, an arbitrary "physical medium for fixing" such as ROM, RAM, HD or the like built in various computer systems, or a "communication medium" holding programs for a short period of time as in a communication network or a carrier wave when programs are transmitted via a network represented by LAN, WAN or the internet.

BRIEF DESCRIPTION OF THE DRAWINGS

A preferred form of the present invention is illustrated in the accompanying drawings in which.

DETAILED DESCRIPTION OF THE PREFERRED EMBODIMENTS

A detailed explanation will be given of the invention with reference to the drawings as follows. Further, the invention is not limited by the embodiments described herein.

(Embodiment 1)

Figure 1:
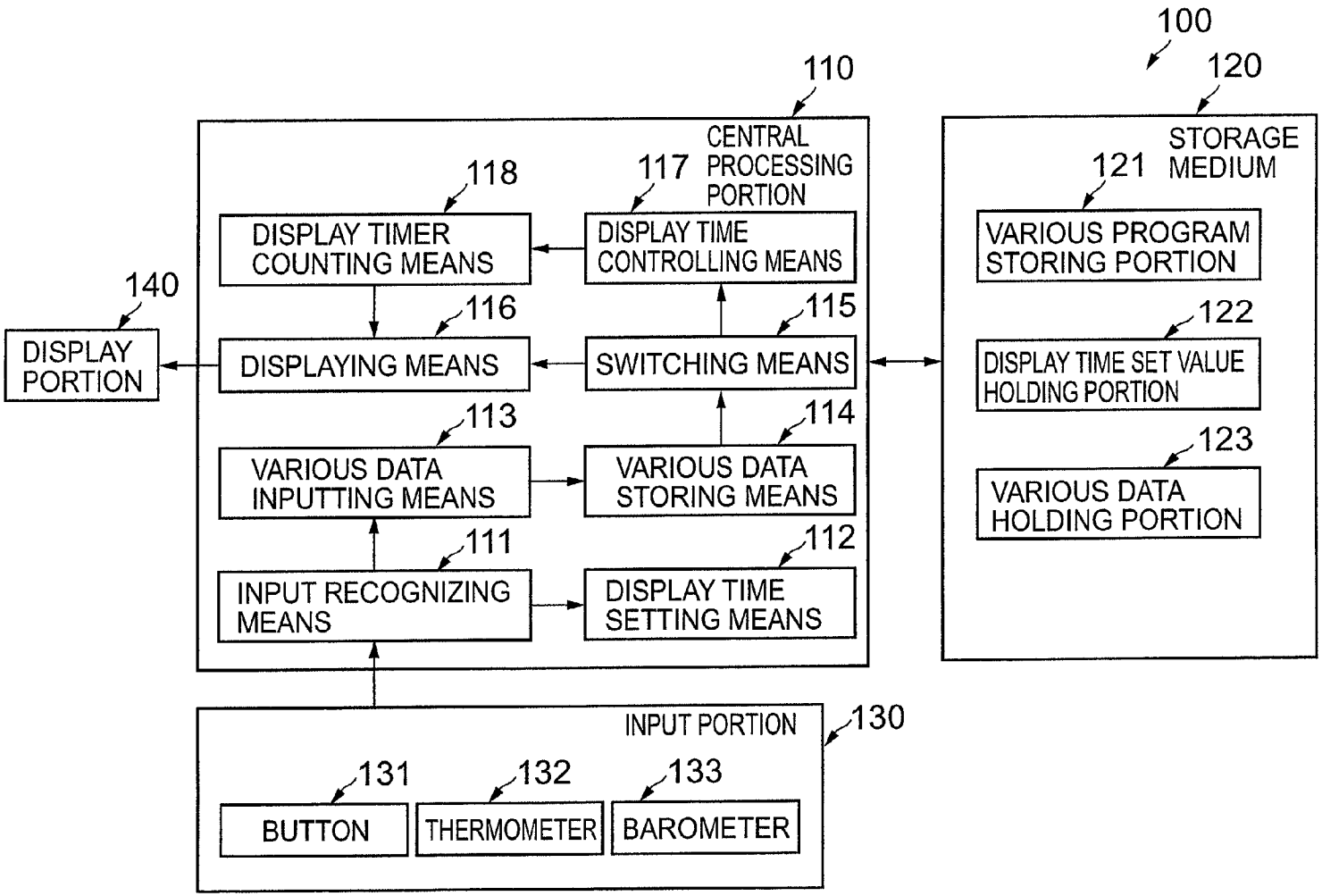
FIG. 1 is a block diagram showing a function of realizing a display switching method of an electronic timepiece of Embodiment 1 according to the invention.
Figures 2, 3:
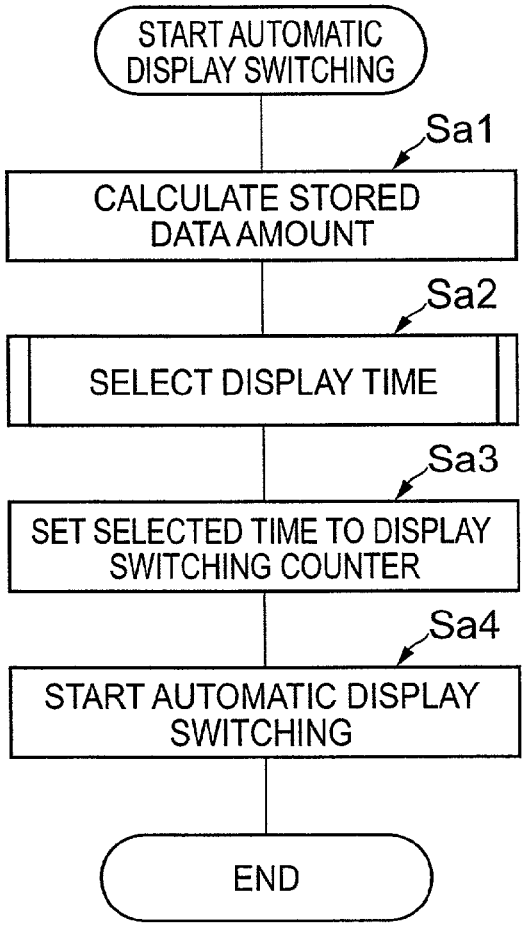
FIG. 2 is a diagram for exemplifying a display time selecting table for setting a display switch timing of the electronic timepiece of Embodiment 1 according to the invention.
FIG. 3 is a flowchart for explaining a display switching processing of the electronic timepiece of Embodiment 1 according to the invention.

FIG. 1 is a block diagram showing a function of realizing a display switching method of an electronic timepiece according to Embodiment 1 of the invention. Further, FIG. 2 is a diagram for exemplifying a display time selecting table for setting a display switch timing of the electronic timepiece according to Embodiment 1 of the invention. An electronic timepiece 100 according to the invention is mainly provided with a central processing portion 110, a storage portion 120, an input portion 130 and a display portion 140.

The central processing portion 110 is mainly provided with input recognizing means 111, display time setting means 112, various data inputting means 113, various data storing means 114, switching means 115, displaying means 116, display time controlling means 117 and display timer counting means 118. Further, there are further provided time counting means and lap time measuring means, not illustrated.

The input recognizing means 111 recognizes what kind of data is inputted from the input portion 130 and transmits data to the display time setting means 112 when the data is set and display time is inputted. Further, in the case of various data, the input recognizing means 111 transmits data to the various data inputting means 113.

The display time setting means 112 holds display time inputted from the input portion 130 by a user to a display time set value holding portion 122 of the storage medium 120. The display time is set in accordance with, for example, amounts of various data. For example, as shown by FIG. 2, in the case of a number of memories of 1 through 9, the display time is set to 3 seconds, in the case of the number of memories 10 through 20, the display time is set to 2.5 seconds, in the case of the number of memories of 21 through 30, the display time is set to 2 seconds, in the case of the number of memories of 31 through 40, the display time is set to 1.5 seconds, in the case of the number of memories of 41 through 50, the display time is set to 1 second and in the case of the number of memories of 51 or more, the display time is set to 0.5 second. Further, the display time period of 3 seconds is a time period generally for everybody easy to see and the display time of 0.5 second is a time period generally necessary for everybody to grasp data. However, these values are only references and are not necessarily preferable values since there is an individual difference.

As described above, the display time may be set in accordance with ranges of reference values of amounts of various data, or may be set in accordance with values constituting references of amounts of various data. Further, the display time may be set by total display time. For example, in the case in which longest total display time is set to 15 seconds and reference display time (for example, a time period in the case of switching at intervals of 3 seconds) is set, when an amount of acquired data is 6, in the case of displaying all the acquired data, it takes 18 seconds and therefore, the display time becomes longer than the longest total display time of 15 seconds. Therefore, the display time is set such that 6 of data is displayed to switch a screen at intervals of 2 seconds to be able to display all of the data within the longest total display time of 15 seconds.

The data inputting means 113 recognizes input of various data such as lap time, temperature, atmospheric pressure or the like and delivers the various data to the various data storing means 114. The various data storing means 114 makes the storage medium 120 store the inputted various data. The switching means 115 reads a display time set value and various data stored to the storing means 120 and switches the display time in accordance with amounts of the various data. The switching is carried out based on the set value such as the above-described reference value or the like and the table as shown by FIG. 2. The displaying means 116 makes the display portion 140 display various data based on the display time switched by the switching means 115.

The display time controlling means 117 and the display timer counting means 118 generates a clock based on the display time switched by the switching means 115 to thereby count the display time and transmits the elapse of the display time to the displaying means 116 to thereby make the displaying means 116 switch the screen.

The storage medium 120 is mainly provided with a various program storing portion 121 for storing various programs for making the central processing portion 110 process the processings of the invention, the display time set value holding portion 122 for setting the display time and a various data holding portion 123 for holding the various data.

The input portion 130 is provided with, for example, a button 131 operated by the finger of a user or the like, a thermometer 132 for measuring temperature and a barometer 133 for calculating an altitude by measuring atmospheric pressure. Further, the central processing portion 110 is provided with altimeter means, not illustrated, for calculating the altitude based on the atmospheric pressure. Further, in the following explanation, an explanation will be given by assuming a case in which the central processing portion 110 reads various programs form the storage medium 120 and pertinently executes the various programs. Incidentally, the electronic timepiece 100 is provided with an oscillating circuit, not illustrated, and is provided with means for generating a clock as a timer along with the above-described various constitutions. Further, although there are means for realizing other functions, mentioned late, other than the above-described constituent portions of releasing the various functions, illustration thereof is omitted and an explanation will be given such that the central processing portion 110 executes all of the processes.

Further, the storage medium 120 is constituted by an involatile memory such as a hard disk device, a magneto-optical disk device, a flash memory or the like, or a volatile memory such as [a storage medium capable of only reading as in CD-ROM etc] RAM (Random Access Memory), or combinations of these.

FIG. 3 shows a flowchart for explaining a display switching processing of the electronic timepiece of Embodiment 1 according to the invention. Further, in the following processing, various data are acquired by using various functions of the electronic timepiece 100 by a user and successively held by the respective data holding portion 123 of the storage medium 120. Further, the display time in accordance with the amount of data is previously set by the user, and held in the display time set value holding portion 122.

Further, when the input recognizing means 111 recognizes depression of the button 131 by depressing the button 131 by, for example, a user, the switching means 115 reads various data to be displayed from the storage medium 120 and calculates the amount of data (step Sa1). The switching means 115 reads the set value of the display time set value holding portion 122 to thereby recognize to set the calculated amount of data and selects the display time to be switched (step Sa2). The switching means 115 transmits the switched display time to the display time controlling means 117 and the displaying means 116. The display time controlling means 117 sets the display timer of the display timer counting means 118 to a selected time display (step Sa3). The display timer counting means 118 counts the set display time and transmits a timing signal to the displaying means 116 at respective elapse of the display time. The displaying means 116 makes the display portion 140 successively display the various data based on the timing signal (step Sa4).

Figure 4:
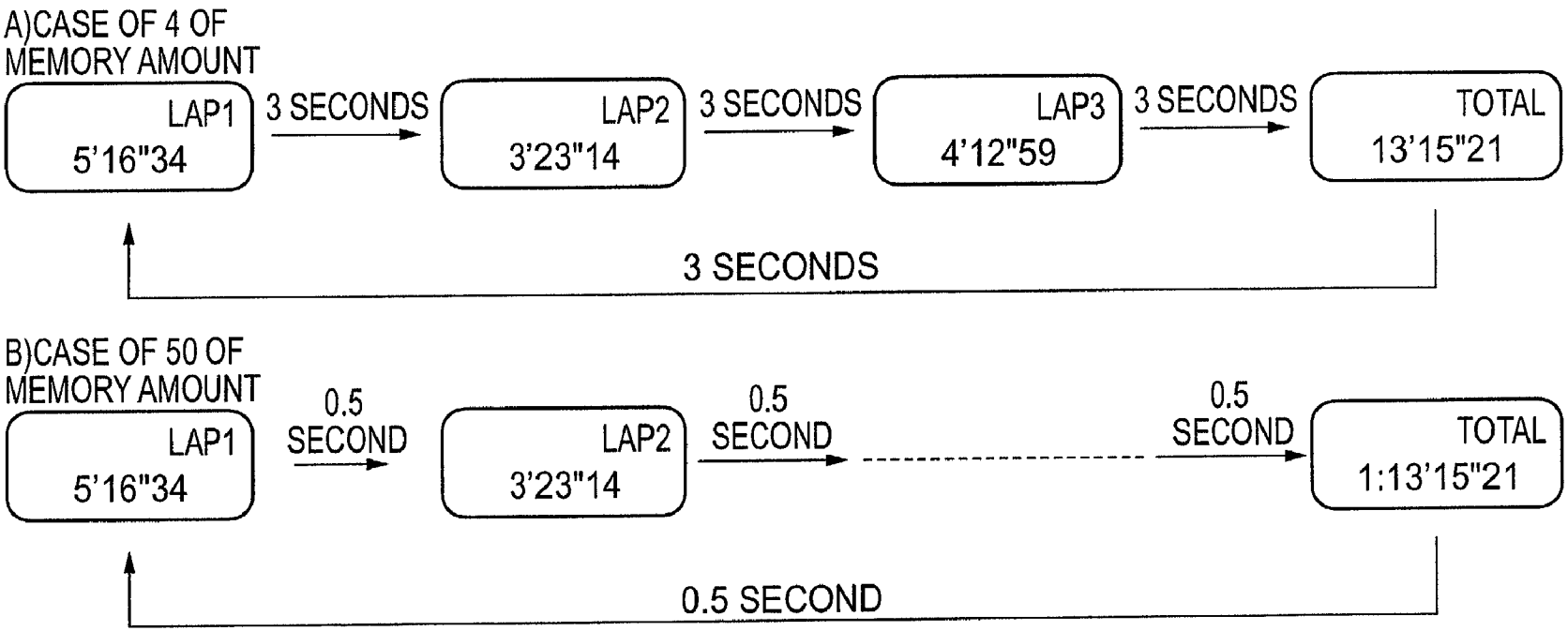
FIG. 4 is a view showing a transitional change example 1 of a display screen for explaining the display switch timing of the electronic time piece of the Embodiment 1 according to the invention.
Figure 5:
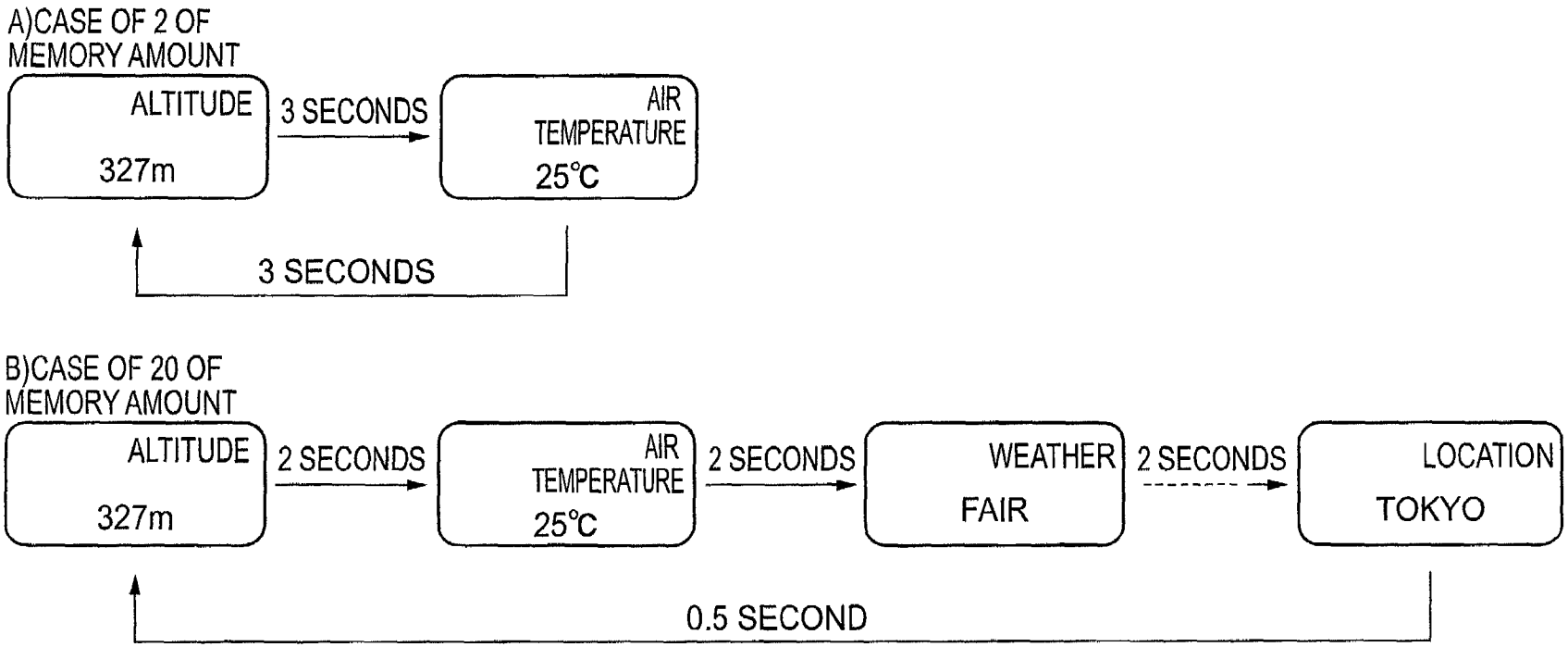
FIG. 5 is a view showing an transitional change example 2 of the display screen for explaining the display switch timing of the electronic timepiece of Embodiment 1 according to the invention.

Next, an explanation will be given of examples of switching the display screen based on the memory amounts of the various data. FIG. 4 is a view showing Transitional Change Example 1 of the display screen for explaining the display switch timing of the electronic timepiece of Embodiment 1 according to the invention. FIG. 5 is a view showing Transitional Change Example 2 of the display screen for explaining the display switch timing of the electronic timepiece of Embodiment 1 according to the invention.

As shown by FIG. 4, in the case of displaying lap time, when the memory amount is 4, the screen is switched at intervals of 3 seconds and when the memory amount is 50, the screen is switched at intervals of 0.5 second. Thereby, even when the memory amount is 50, total display time becomes about 25 seconds and all the data can be displayed more fastly than the total display time of 150 seconds in which the screen is switched at intervals of 3 seconds.

As shown by FIG. 5, when the display is switched at intervals of 3 seconds and in the case of displaying only altitude and temperature and when there are 20 data of altitude, temperature, weather, location and the like, these data are displayed to switch successively at intervals of 2 seconds.

Figure 6:
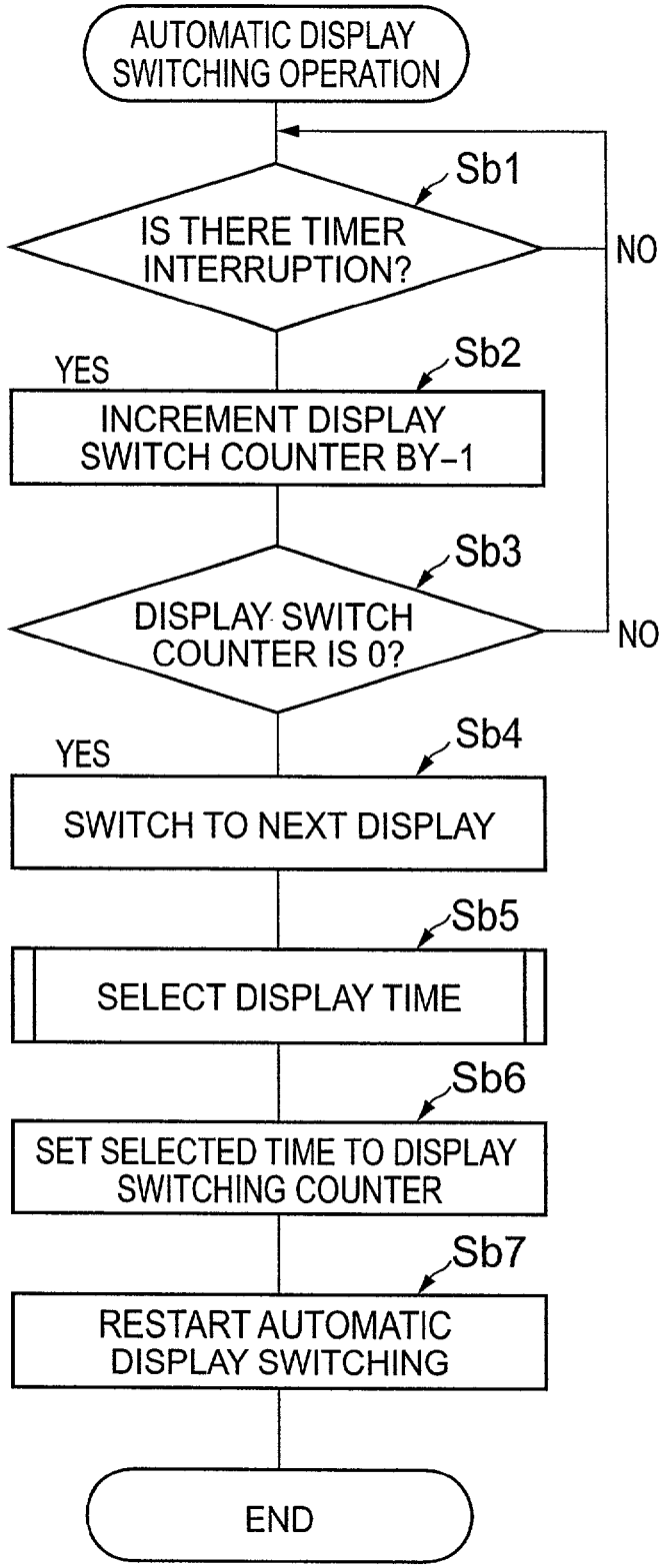
FIG. 6 is a flowchart for explaining other example 1 of a display switching processing of the electronic timepiece of Embodiment 1 according to the invention.

FIG. 6 is a flowchart for explaining another example 1 of the display switching processing of the electronic timepiece of Embodiment 1 according to the invention. Further, in the following explanation, an explanation will be given such that the central processing portion 110 processes the processing steps.

First, when there is an interruption of the timer, the central processing portion 110 increments the display switching counter by −1 (steps Sb1, Sb2), and when 0 is reached, the central processing portion 110 successively switches the display (steps Sb3, Sb4). In the following, step Sb5, step Sb6 and step Sb7 execute processings the same as those of step Sa2, step Sa3 and step Sa4, mentioned above.

Figure 7:
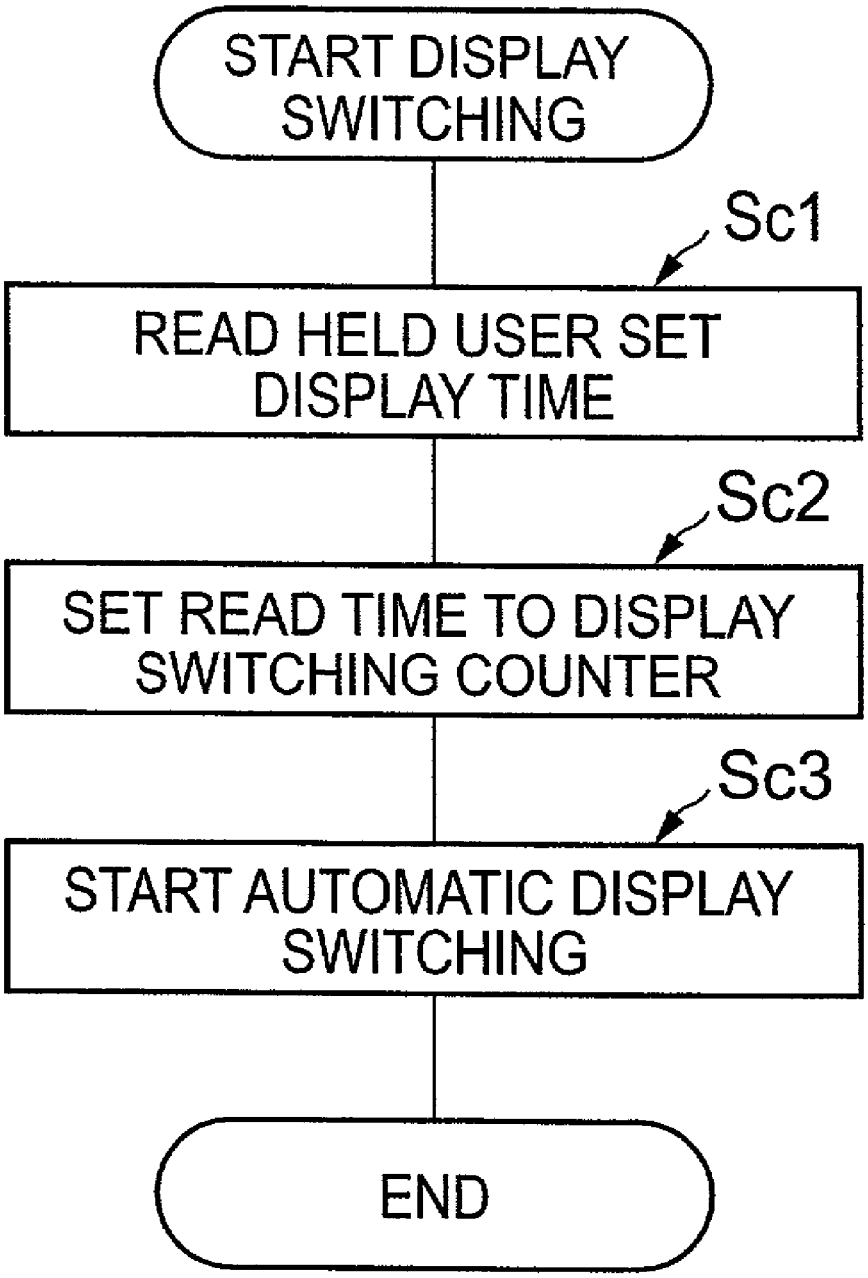
FIG. 7 is a flowchart for explaining other example 2 of a display switching processing of the electronic timepiece of Embodiment 1 according to the invention.

FIG. 7 is a flowchart for explaining another example 2 of the display switching processing of the electronic timepiece of Embodiment 1 according to the invention. Further, in the following explanation, an explanation will be given such that the central processing portion 110 processes the processing steps. In this case, there is shown a processing of switching display necessarily when, for example, the button 131 is depressed. For example, when the button 131 is depressed to display the various data, the central processing portion 110 reads the display time from the storage medium 120 (step Sc1) and executes display by setting the display to display time of fixing display of data in displaying for a predetermined period of time (step Sc2, step Sc3).

According to Embodiment 1, mentioned above, the display can be switched in accordance with the amount of data and, therefore, there can be provided the display switching method of the electronic timepiece preferable in the way of use by the user by displaying to switch the screen in accordance with the amount of data in the state of ensuring the optical recognizability of the user even when the amount of data is large as in measured lap time, as well as the electronic timepiece and the display switching program for the electronic timepiece.

(Embodiment 2)

Figure 8:
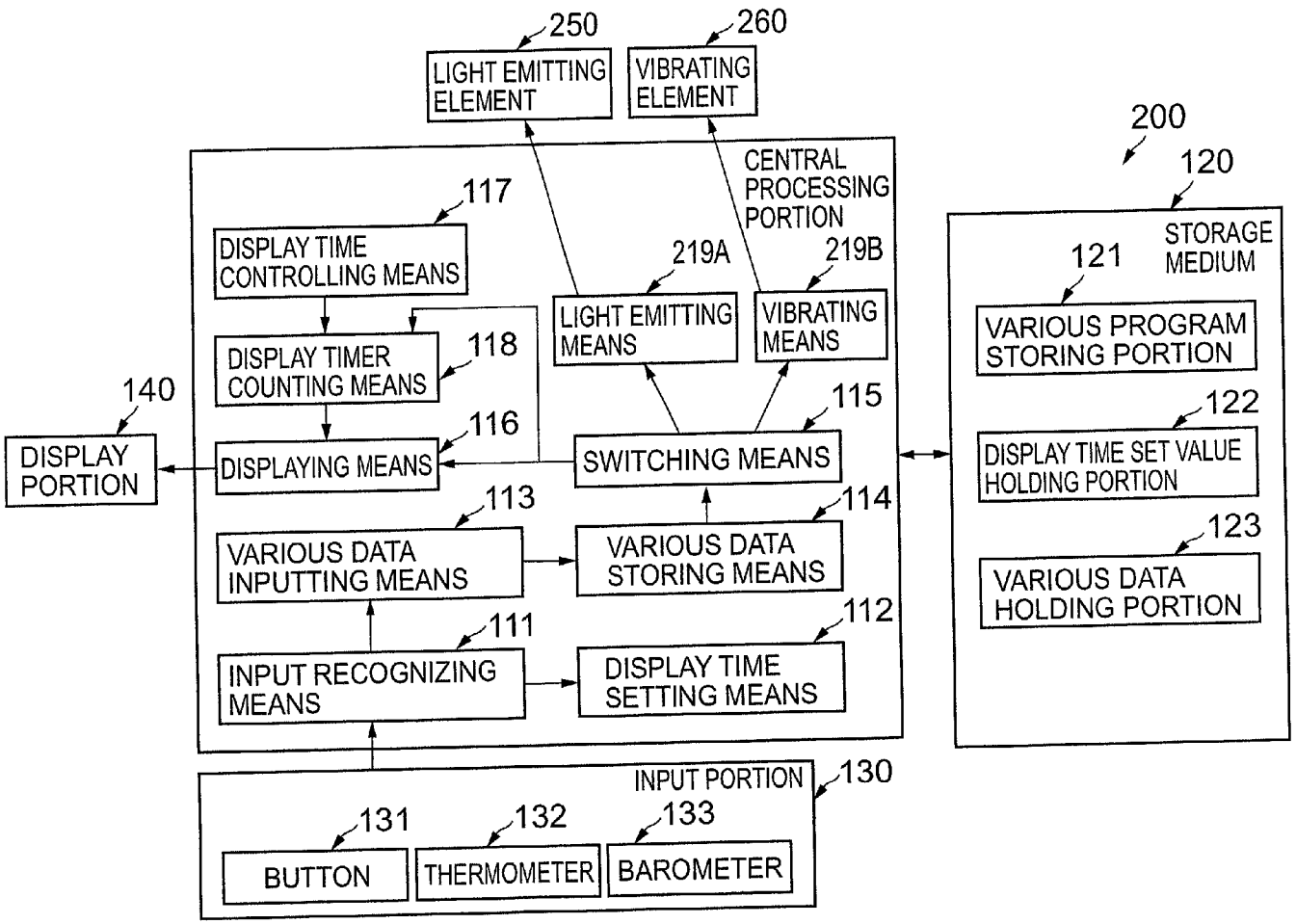
FIG. 8 is a block diagram showing a function of realizing a display switching method of an electronic timepiece of Embodiment 2 according to the invention.

FIG. 8 is a block diagram showing a function of realizing a display switching method of an electronic timepiece of Embodiment 2 according to the invention. Further, portions having functions the same as those of Embodiment 1, mentioned above, are attached with the same notations. The electronic timepiece 100 according to the invention is mainly provided with the central processing portion 110, the storage medium 120, the input portion 130, the display portion 140, a light emitting element 250 and a vibrating element 260.

The central processing portion 110 is mainly provided with the input recognizing means 111, the display time setting means 112, the various data inputting means 113, the various data storing means 114, the switching means 115, the displaying means 116, the display time controlling means 117, the display timer counting means 118, light emitting means 219*a* and vibrating means 219*b*. Further, the central processing portion 110 is further provided with counting means and lap time measuring mean, not illustrated. Further, the input recognizing means 111, the display time setting means 112, the various data inputting means 113, the various data storing means 114, the switching means 115, the displaying means 116, the display time controlling means 117 and the display timer counting means 118 are respectively the same as the functions explained in Embodiment 1, mentioned above.

Meanwhile, the light emitting means 219*a* makes the light emitting element 250 emit light. The vibrating means 219*b* vibrates the vibrating element 260. The light emitting element 250 is constituted by a liquid crystal display or a light emitting diode. The vibrating element 260 is constituted by a piezoelectric element or various kinds of vibration motors. Further, the light emitting means 219*a* and the vibrating means 219*b* are operated based on signals from the switching means 115. The switching means 115 makes the light emitting element 250 emit light and vibrates the vibrating element 260 in synchronism with displaying to switch the screen of the various data by the displaying means 116.

Further, the storage medium 120 is mainly provided with the various program storing portion 121, the display time set value holding portion 222 and the various data holding portion 123. As the input portion 130, similar to Embodiment 1, mentioned above, there are, for example, the button 131, the thermometer 132 and the barometer 133 and so on. Incidentally, according to Embodiment 2, the button 131 is provided with an exclusive button for instructing to turn on the light emitting element 250, referred to as a light button. Further, although in this case, the light button instructs light emittance of the light emitting element 250 as well as vibration of the vibrating element 260 by depressing thereof, other than the light button, there may be provided a vibration button for instructing vibration. Further, the central processing portion 110 is provided with altimeter means, not illustrated, for calculating altitude based on atmospheric pressure.

Further, also in the following explanation, similar to Embodiment 1, mentioned above, an explanation will be given by assuming a case in which the central processing portion 110 pertinently executes processings by reading various programs from the storage medium 120. Incidentally the electronic timepiece 100 is provided with an oscillating circuit, not illustrated, and provided with means for generating a clock as a timer along with the above-described various constitutions. Further, although the central processing portion 110 is provided with means for realizing a function, mentioned later, other than constituent portions for realizing various functions, mentioned above, illustration thereof is omitted and an explanation will be given such that the central processing portion 110 executes all the processings.

Further, the storage medium 120 is constituted by an involatile memory such as a hard disk device, a magneto-optic disk device, a flash memory or the like, or a volatile memory such as [a storage medium capable of reading such as CD-ROM etc] RAM (Random Access Memory), or combinations of these.

Figure 9:
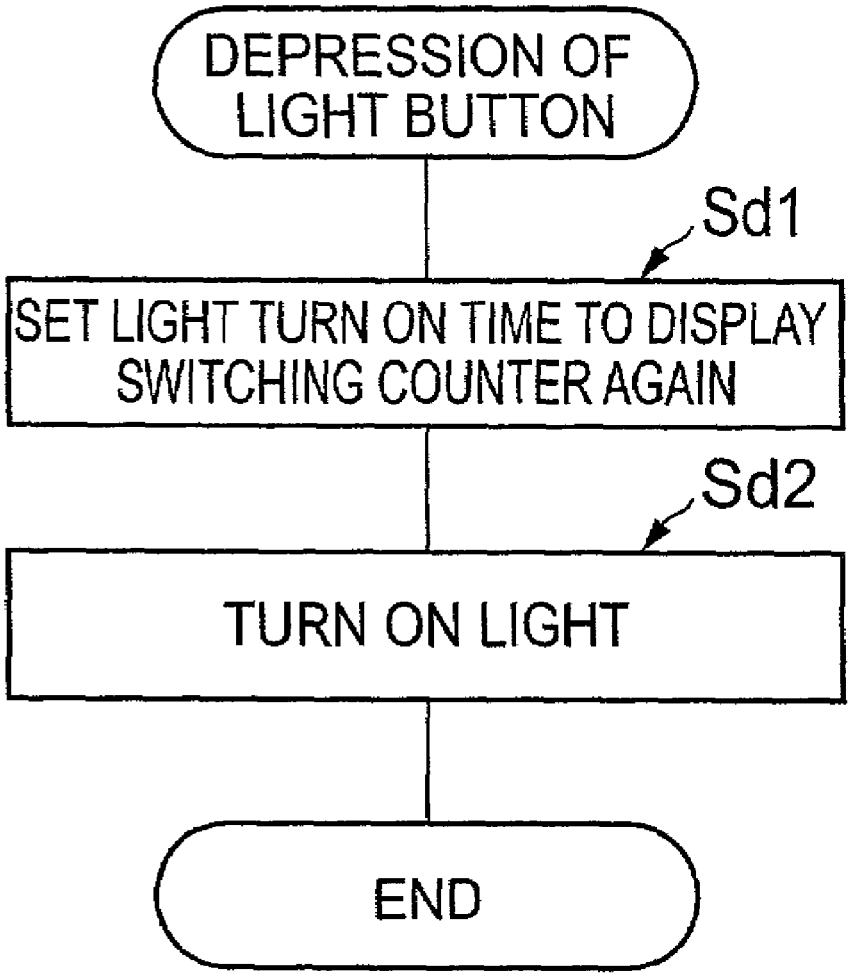
FIG. 9 is a flowchart for explaining the display switching processing of the electronic timepiece of Embodiment 2 according to the invention.

FIG. 9 is a flowchart for explaining a display switching processing of the electronic timepiece of Embodiment 2 according to the invention. Further, in the following processing, the various data are acquired by using various functions of the electronic timepiece by the user and successively stored to the respective data holding portion 123 of the storage medium 120. Further, the display time in accordance with the amount of data is previously set by the user and held in the display time set value holding portion 122.

First, when the user depresses the button 131 for issuing instruction for displaying the various data, at the central processing portion 110, when the input recognizing means 111 recognizes depression of the button 131, the various data displayed by the switching means 115 are read from the storage medium 120 and the amount of data is calculated. The switching means 115 reads the set value of the display time set value holding portion 122, recognizes to set the calculated amount of data and selects the display time to be switched. The switching means 115 transmits the switched display time to the display time controlling means 117 and the displaying means 116.

The display time controlling means 117 sets the display timer of the display timer counting means 118 to the selected display time. The display timer counting means 118 counts the set display time and transmits the timing signal to the displaying means 116 at respective elapse of the display time. The displaying means 116 successively makes the display portion 140 display the various data based on the timing signals. The above-described processing is the same as the processing explained in reference to the flowchart of FIG. 3 in Embodiment 1, mentioned above.

Meanwhile, according to Embodiment 2, when the light button is depressed in the above-described processing, at the central processing portion 110, light turn on time is set again to the display switching counter (step Sd1). For example, when the light button is depressed during a time period of displaying the various data at intervals of 0.5 second, data displayed in depressing the light button is switched to successive data by setting an interval of 3 seconds therebetween. That is, there is set to fix the data displayed during the time period of depressing the light button by the interval of 3 seconds. Further, the light emitting means 219*a* and the vibrating means 219*b* respectively makes the light emitting element 250 emit light and vibrates the vibrating element 260, fixes the data displayed when the light button is depressed and turns off the light emitting element 250 and stops vibrating the vibrating element 260 and switch to successive data when a set time period, for example, 3 seconds has elapsed.

Figure 10:
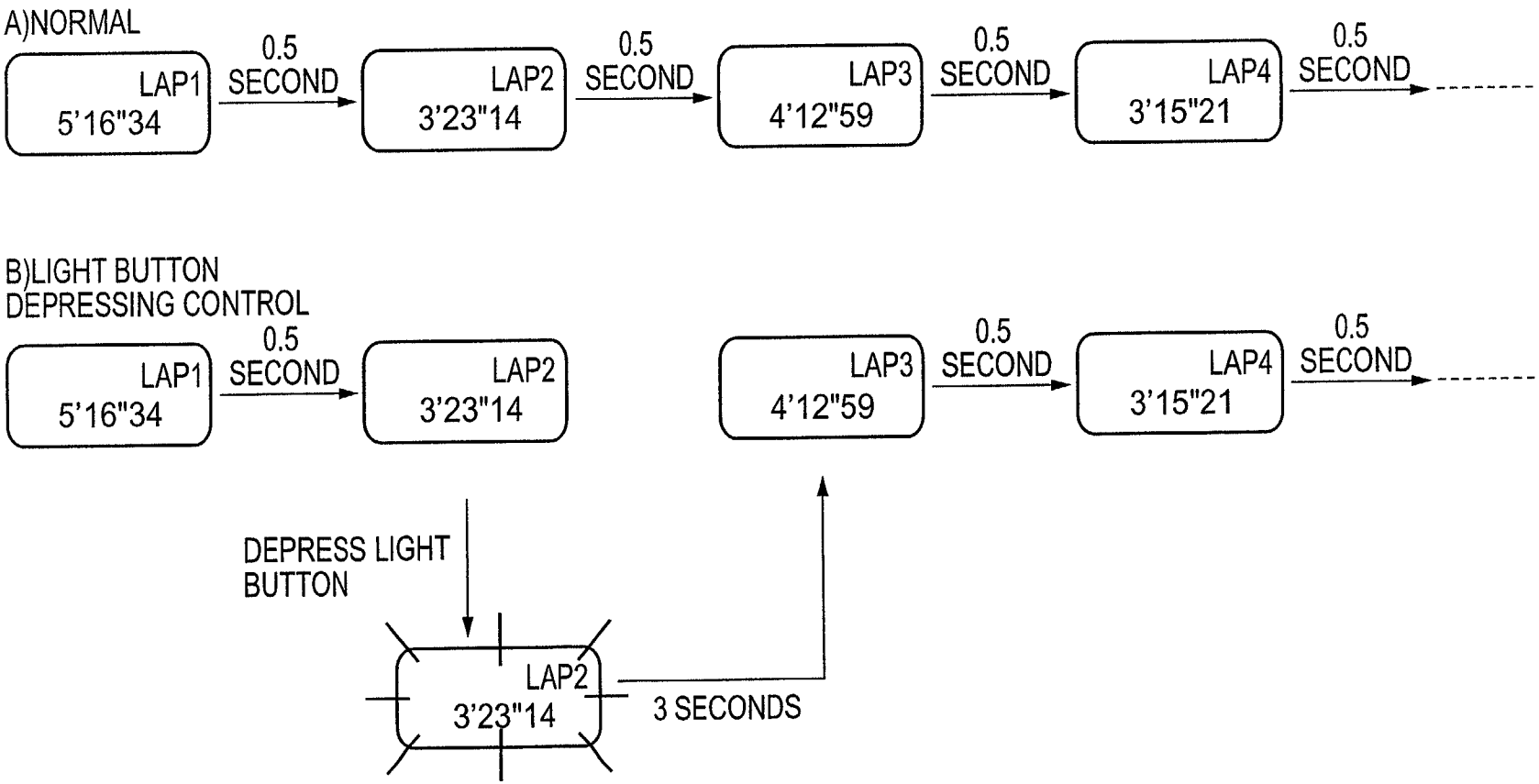
FIG. 10 is a view showing transitional change of the display screen for explaining a display switch timing of the electronic timepiece of Embodiment 2 according to the invention.

Next, an explanation will be given of an example of switching the display screen. FIG. 10 is a view showing transitional change example 1 of the display screen for explaining the display switch timing of the electronic timepiece of Embodiment 2 according to the invention. As shown by FIG. 10, when the lap time is displayed, first, the display screen is switched at intervals of 0.5 second and when the light button is depressed, the screen displayed when the light button is depressed, is fixed for 3 seconds and during the time period, light emittance and vibration are executed. Thereby, a user can pay attention to data when the light button is depressed and therefore, there can be executed a display in correspondence with operation of the user for confirming the various data.

Next, an explanation will be given of other examples 1, 2 and 3 of the display switching processing of the electronic timepiece of Embodiment 2 according to the invention. Further, in the following processing, the various data are acquired by using the various functions of the electronic timepiece 100 by the user and successively held in the various data holding portion 123 of the storage medium 120. Further, the display time in accordance with the amount of data is previously set by the user and held in the display time set value holding portion 122.

Figure 11:
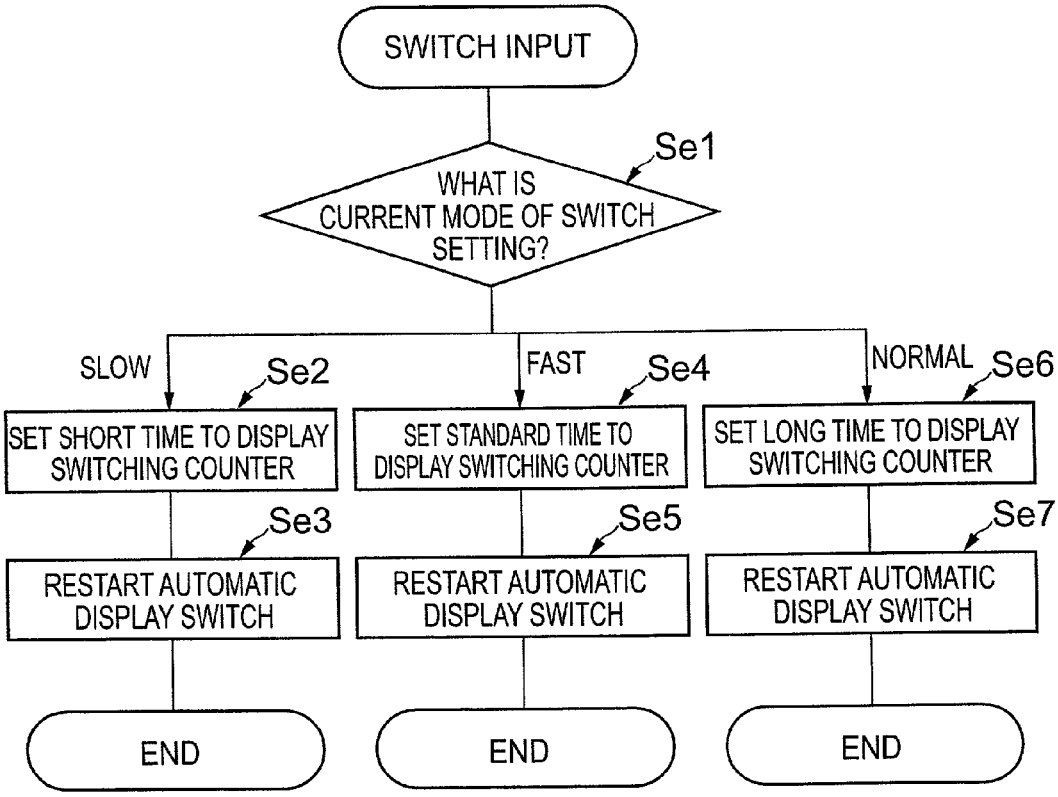
FIG. 11 is a flowchart for explaining other example 1 of the display switching processing of the electronic timepiece of Embodiment 2 according to the invention.

FIG. 11 is a flowchart for explaining another example 1 of the display switching processing of the electronic timepiece of Embodiment 2 according to the invention. First, when the user depresses the button 131 for issuing an instruction for displaying the various data, at the central processing portion 110, when the input recognizing means 111 recognizes depression of the button 131, the various data displayed by the switching means 115 is read from the storage medium 120 and the amount of data is calculated. The switching means 115 reads the set value of the display time set value holding portion 122, recognizes setting the calculated amount of data and selects the display time to be switched. The switching means 115 transmits the switched display time to the display time controlling means 117 and the displaying means 116. The display time controlling means 117 sets the display timer of the display timer counting means 118 to the selected display time. The display timer counting means 118 counts the set display time and transmits the timing signal to the displaying means 116 at respective elapse of the display time. The displaying means 116 makes the display portion 140 successively display the various data based on the time signal. The above-described processing is the same as the processing explained in Embodiment 1, mentioned above, with reference to the flowchart of FIG. 3.

Meanwhile, according to the processing of other example 1 of Embodiment 2, when the light button is depressed during the above-described processing, the central processing portion 110 firstly confirms what is the current mode of switch setting (stepSe1). Here according to the mode, for example, in setting the display time in accordance with the number of memories explained in reference to FIG. 2 in Embodiment 1, mentioned above, the mode is low mode in the case of a number of memories of 1 through 20, a normal mode in the case of the number of memories of 21 through 40 and a fast mode in the case of the number of memories of 41 or more.

The central processing portion 110 sets a short time period to the display switching counter in the case of the slow mode currently and restarts automatic display switch (steps Se2, Se3). In the case of the fast mode, the central processing portion 110 sets a standard time period to the display switch counter and restarts the automatic display switching (steps Se4, Se5). Further, in the case of a normal mode currently, the central processing portion 110 sets a long time period to the display switch counter and restarts the automatic display switching (steps Se6, Se7). However, as mentioned above, the respective mode is respectively provided with two stages of the display time and therefore, it is previously set to which display time the display time is switched. For example, when the display is carried out by the display time of 2.0 seconds in the case of the number of memories of 21 through 30, the display is set to switch to the display time of 1.0 second in the case of the number of memories of 41 through 50. Further, in the processing, the light emitting element 250 may emit light and the vibrating element 260 may be vibrated.

Figure 12:
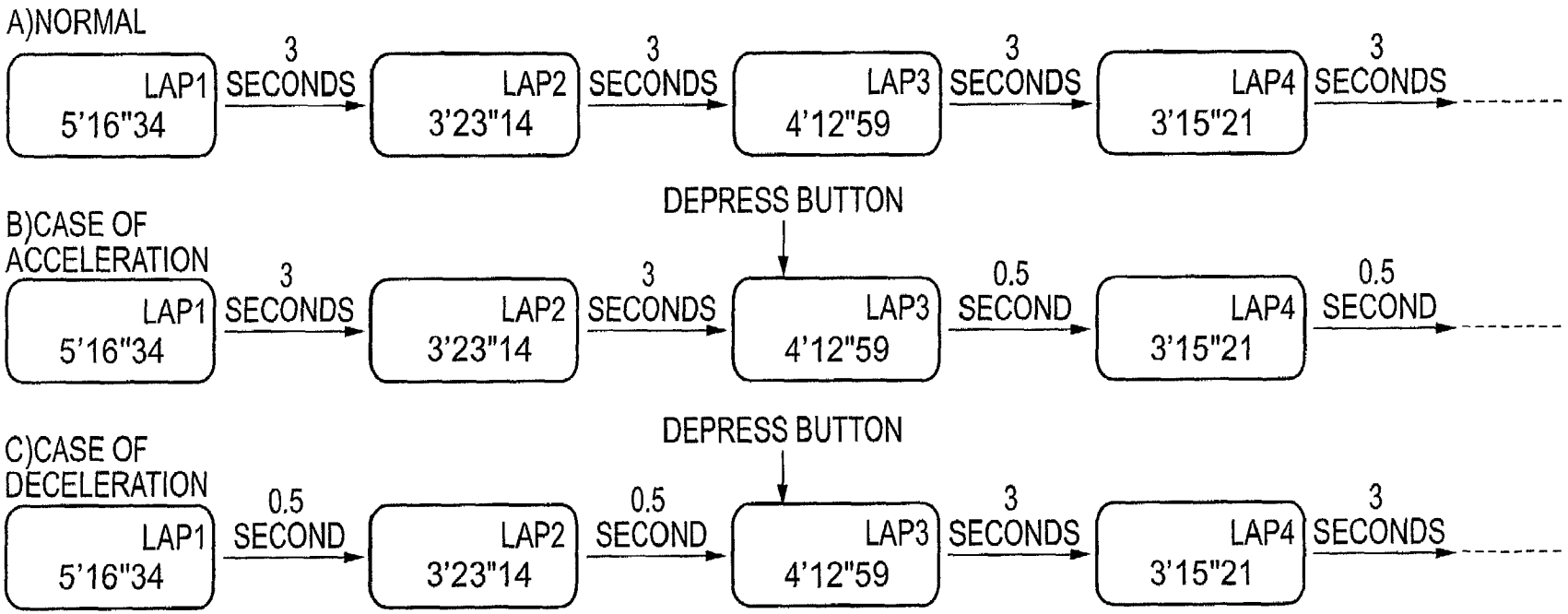
FIG. 12 is a view showing transitional change of the display screen for explaining other example 1 of the display switch timing of the electronic timepiece of Embodiment 2 according to the invention.

FIG. 12 is a view showing a transitional change of the display screen for explaining other example 1 of the display switch timing of the electronic timepiece of Embodiment 2 according to the invention. In the case of the normal mode, the screen is switched at intervals of 3 seconds. Further, when the button is depressed in the case of the normal mode, the display is carried out by switching the display time from 3 seconds to 0.5 second. Further, when the button is depressed in the case of the slow mode, display is carried out by switching the display time from 0.5 second to 3 seconds.

Figure 13:
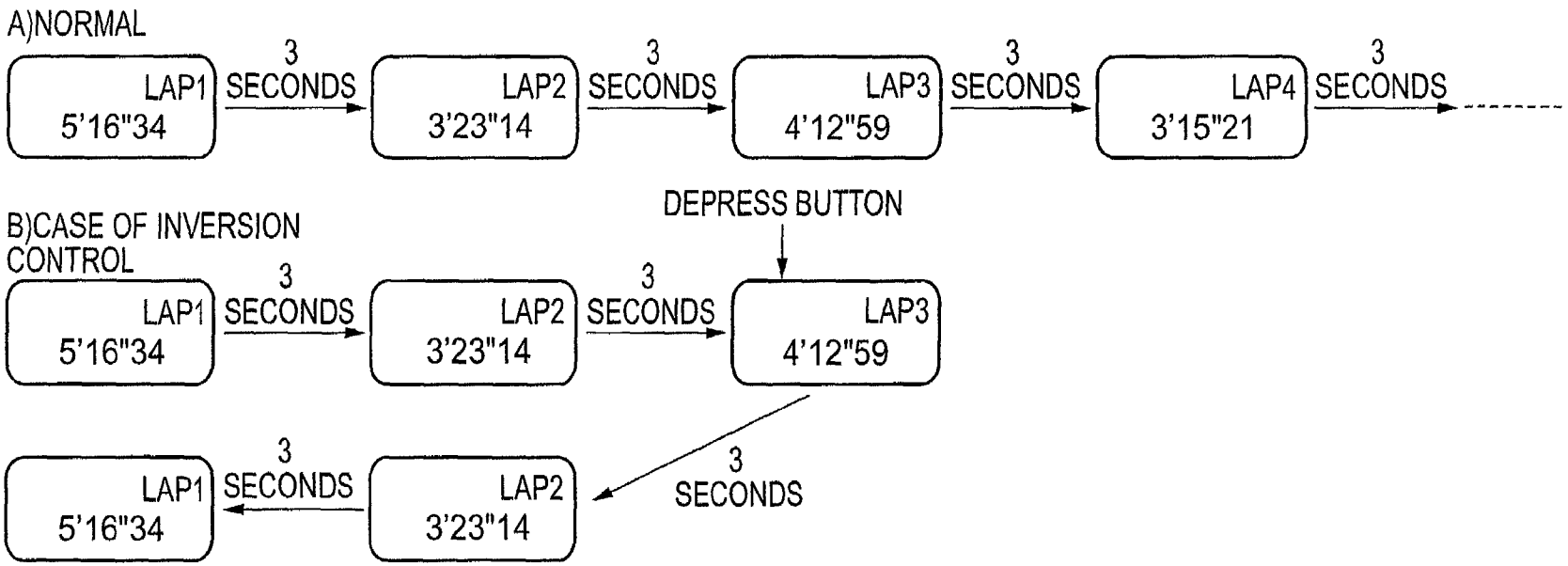
FIG. 13 is a view showing transitional change of the display screen other example 2 of the display switch timing of the electronic timepiece of Embodiment 2 according to the invention.

FIG. 13 is a view showing a transitional change of the display screen for explaining other example 2 of the display switch timing of the electronic timepiece of Embodiment 2 according to the invention. In the case of the normal mode, the screen is switched at intervals of 3 seconds. Further, in the case of other example 2, when the button is depressed in the case of, for example, the normal mode, the display time is made to stay as it is and the display data is inverted. Further, in the case of inversion, the display time may be made long or short. For example, the display may be carried out invertedly by switching the display time of 3 seconds to 5 seconds.

Figure 14:
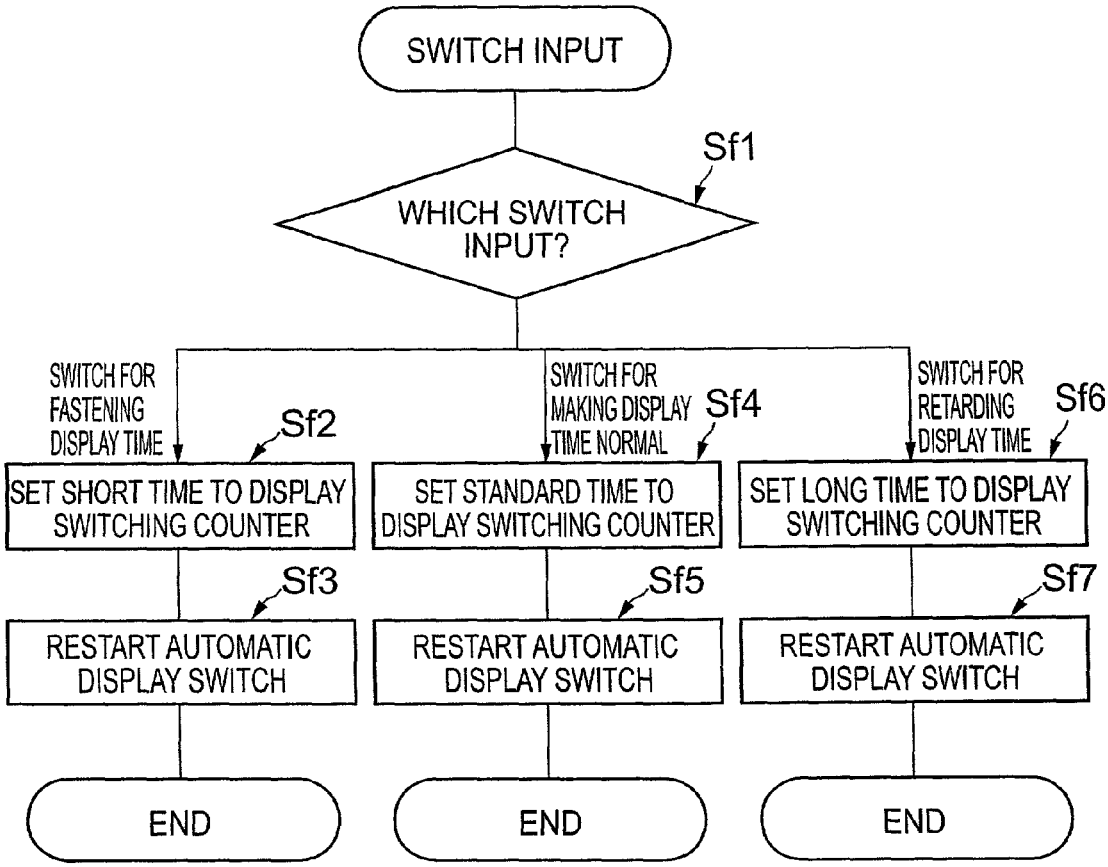
FIG. 14 is a flowchart for explaining other example 2 of the display switching processing of the electronic timepiece of Embodiment 2 according to the invention.

FIG. 14 is a flowchart for explaining another example 2 of display switching processing of the electronic timepiece of Embodiment 2 according to the invention. First, when the user depresses the button 131 for issuing an instruction for displaying the various data, at the central processing portion 110, when the input recognizing means 111 recognizes depression of the button 131, the various data displayed by the switching means 115 is read from the storage medium 120 and the amount of data is calculated. The switching means 115 reads the set value of the display time set value holding portion 122, recognizes setting of the calculated amount of data and selects the display time to be switched.

The switching means 115 transmits the switched display time to the display time controlling means 117 and the displaying means 116. The display time controlling means 117 sets the display timer of the display timer counting means 118 to the selected display time. The display time counting means 118 counts the set display time and transmits the timing signal to the displaying means 116 at respective elapse of the display time. The displaying means 116 makes the display portion 140 successively display the various data based on the timing signal. The above-described processing is the same as the processing explained in reference to a flowchart of FIG. 3 in Embodiment 1, mentioned above.

Meanwhile, according to the example 2, of Embodiment 2, the button 131 is respectively prepared with a switch for fastening the display time, a switch for making the display time normal and a switch for retarding the display time. Further, in the processing of other example 2, when any one of the switches of the button 131 is depressed in the above-described processing, the central processing portion 110 firstly recognizes what switch is depressed currently (step Sf1). The central processing portion 110 sets a short time period to the display switching counter in the case of the switch for fastening the display time and restarts automatic display switching (steps Sf2, Sf3).

In the case of the switch for making the display time normal, a standard time period is set to the display switching counter and the automatic display switching is restarted (step Sf4, Sf5). Further, in the case of the switch for retarding the display time, a long time period is set to the display switching counter and the automatic display switching is restarted (steps Sf6, Sf7). However, as described above, the respective mode is respectively provided with two stages of the display time and therefore, it is previously set to which display time the display time is switched. Further, in the processing, the light emitting element 250 may emit light and vibrating element 260 may be vibrated.

Figure 15:
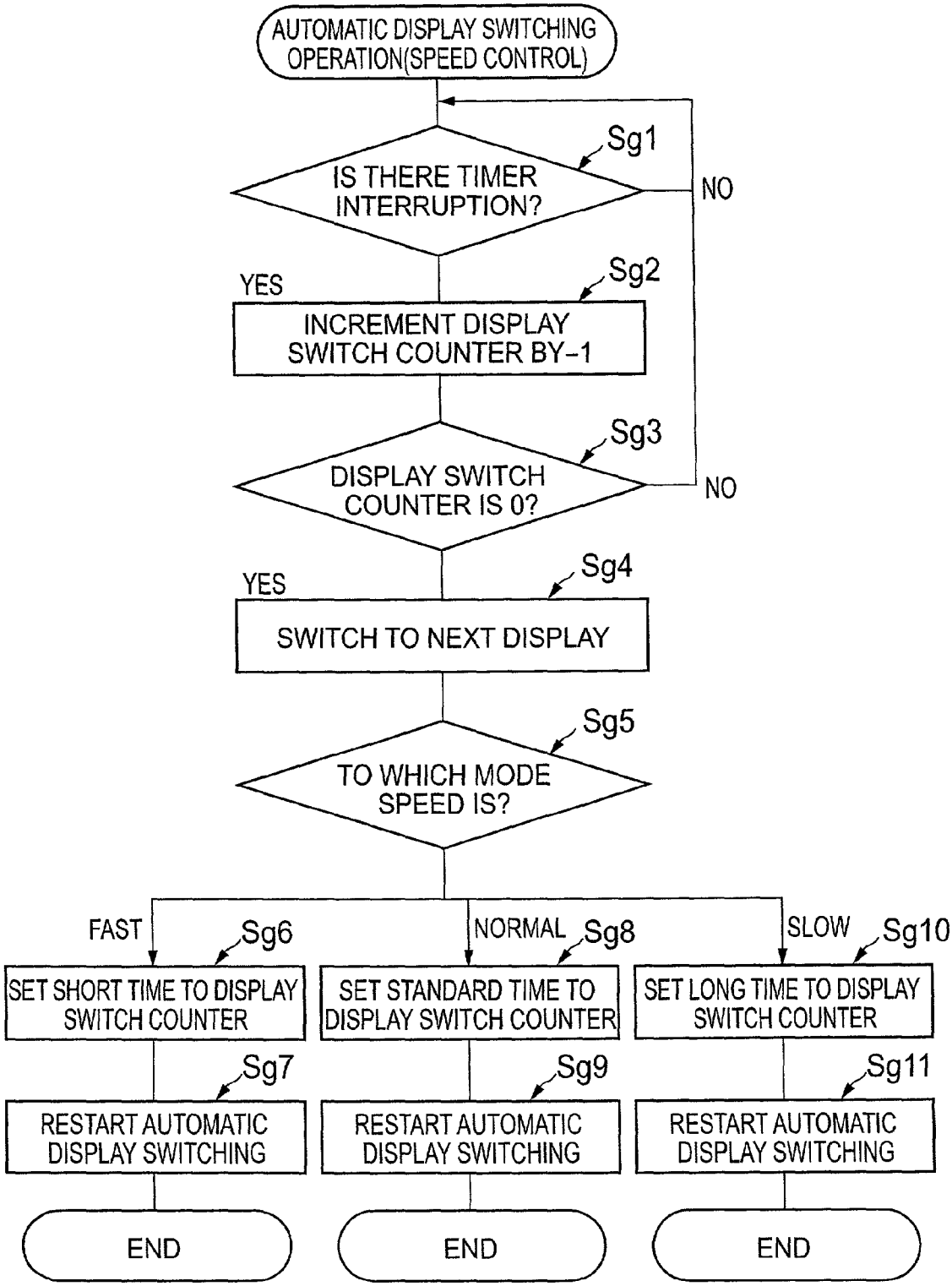
FIG. 15 is a flowchart for explaining other example 3 of the display switching processing of the electronic timepiece of Embodiment 2 according to the invention.

FIG. 15 is a flowchart for explaining another example 3 of the display switching processing of the electronic timepiece of Embodiment 2 according to the invention. First, when the user depresses the button 131 for issuing instruction for displaying the various data, at the central processing portion 110, when the input recognizing means 111 recognizes depression of the button 131, the various data displayed by the switching means 115 are read from the storage medium 120 and the amount of data is calculated. The switching means 115 reads the set value of the display time set value holding portion 122, recognizes setting of the calculated amount of data and selects the display time to be switched.

The switching means 115 transmits the switched display time to the display time controlling means 117 and the displaying means 116. The display time controlling means 117 sets the display timer of the display timer counting means 118 to the selected display time. The display timer counting means 118 counts the set display time and transmits the timing signal to the displaying means 116 at respective elapse of the display time. The displaying means 116 successively displays the various data to the display portion 140 based on the timing signal. The above-described processing is the same as the processing explained in reference to the flowchart of FIG. 3 in Embodiment 1, mentioned above.

Meanwhile, according to the processing of the example 3 of Embodiment 2, the central processing portion 110 increments the display switch counter by −1 when there is an interruption of a timer in the above-described processing (steps Sg1, Sg2) and when 0 is reached, the central processing portion 110 switches to the successive display (steps Sg3, Sg4).

Successively, at the central processing portion 110, it is confirmed to which mode of switch setting is constituted currently (step Sg5). In this case, according to the mode, for example, in setting the display time in accordance with the number of memories explained in reference to FIG. 2 in Embodiment 1, mentioned above, a slow mode is constituted by a number of memories of 10 through 20, a normal mode is constituted by the number of memories 21 through 40 and a fast mode is constituted by the number of memories of 41 or more.

The central processing portion 110 sets a short time period to the display switch counter in the case of the slow mode currently and restarts the automatic display switching (steps Sg6, Sg7). In the case of the fast mode, a standard time period is set to the display switch counter and the automatic display switching is restarted (steps Sg8, Sg9). Further, in the case of the normal mode currently, a long time period is set to the display switch counter and the automatic display switching is restarted (steps Sg10, Sg11). However, as described above, the respective mode is respectively provided with two stages of the display time and accordingly, it is previously set to which display time the display time is switched. Further, in the processing, the light emitting element 250 may emit light or the vibrating element 260 may be vibrated.

According to Embodiment 2, mentioned above, display switching in accordance with the amount of data can be carried out and therefore, there can be provided the display switching method of the electronic timepiece improving the way of use by the user by displaying to switch the screen in accordance with the amount of data in a state of ensuring the optical recognizability of the user even in the case of the large amount of data as in measured lap time, the electronic timepiece and the display switching program of the electronic timepiece.

(Embodiment 3)

Figure 16:
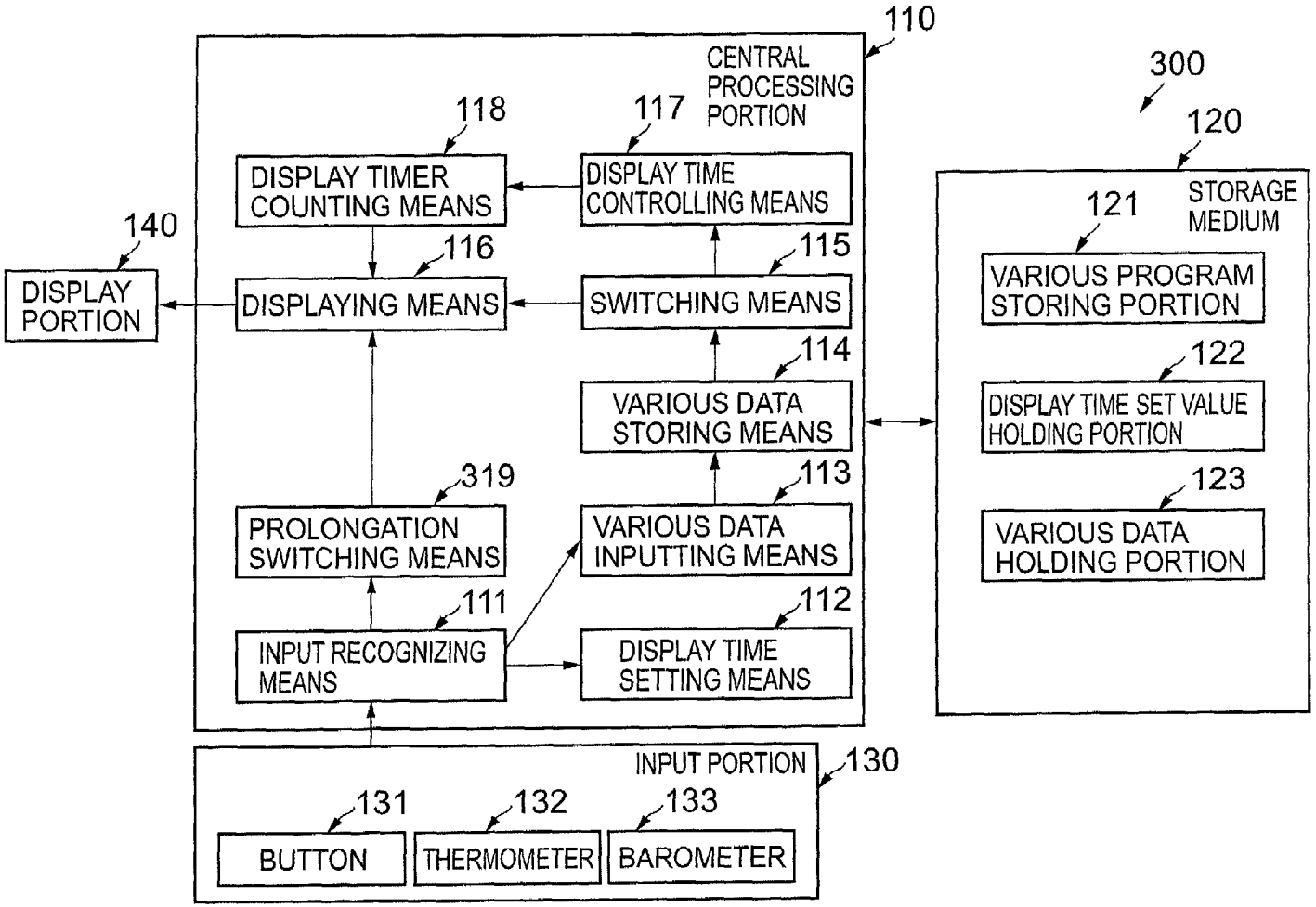
FIG. 16 is a block diagram showing a function for realizing a display switching method of an electronic timepiece of Embodiment 3 according to the invention.

FIG. 16 is a block diagram showing a function of realizing a display switching method of an electronic timepiece of Embodiment 3 according to the invention. Further, functions the same as those in Embodiment 1, mentioned above, are attached with the same notations. The electronic timepiece 100 according to the invention is mainly provided with the central processing portion 110, the storage medium 120, the input portion 130, the display portion 140, the light emitting element 250 and the vibrating element 260.

The central processing portion 110 is mainly provided with the input recognizing means 111, the display time setting means 112, the various data inputting means 113, the various data storing means 114, the switching means 115, the display means 116, the display time controlling means 117, the display timer counting means 118 and prolongation switching means 319. Further, the central processing portion 110 is further provided with counting means and lap time measuring means, not illustrated. Further, the input recognizing means 111, the display time setting means 112, the various data inputting means 113, the various data storing means 114, the switching means 115, the displaying means 116, the display time controlling means 117 and the display timer counting means 118 are respectively the same as the functions explained in Embodiment 1, mentioned above. Further, the storage medium 120 is mainly provided with the various program storing portion 121, the display time set value holding portion 122 and the various data storing holding portion 123. As the input portion 130, similar to Embodiment 1, mentioned above, for example, there are the button 131, the thermometer 132 and the barometer 133 and the like. Further, according to Embodiment 3, the button 131 is provided with a prolongation switch button for instructing prolongation switch. Further, the central processing portion 110 is provided with altimeter means, not illustrated, for calculating altitude based on atmospheric pressure.

Further, also in the following explanation, similar to Embodiment 1, mentioned above, an explanation will be given by assuming a case in which the central processing portion 110 reads various programs from the storage medium 120 and pertinently executes the various programs. Incidentally, the electronic timepiece 100 is provided with an oscillating circuit, not illustrated, and provided with means for generating a clock as a timer along with the above-described various constitutions. Further, although the central processing portion 110 is provided with means for realizing a function, mentioned later, other than constituent portions for realizing the above-described respective functions, illustration thereof is omitted and an explanation will be given such that the central processing portion 110 processes all the processings.

Further, the storage medium 120 is constituted by an involatile memory such as a hard disk device, a magneto-optical disk device, a flash memory or the like or a volative memory [a storage medium capable of reading such as CD-ROM or the like]RAM (Random Access Memory), or combinations of these.

Figure 17:
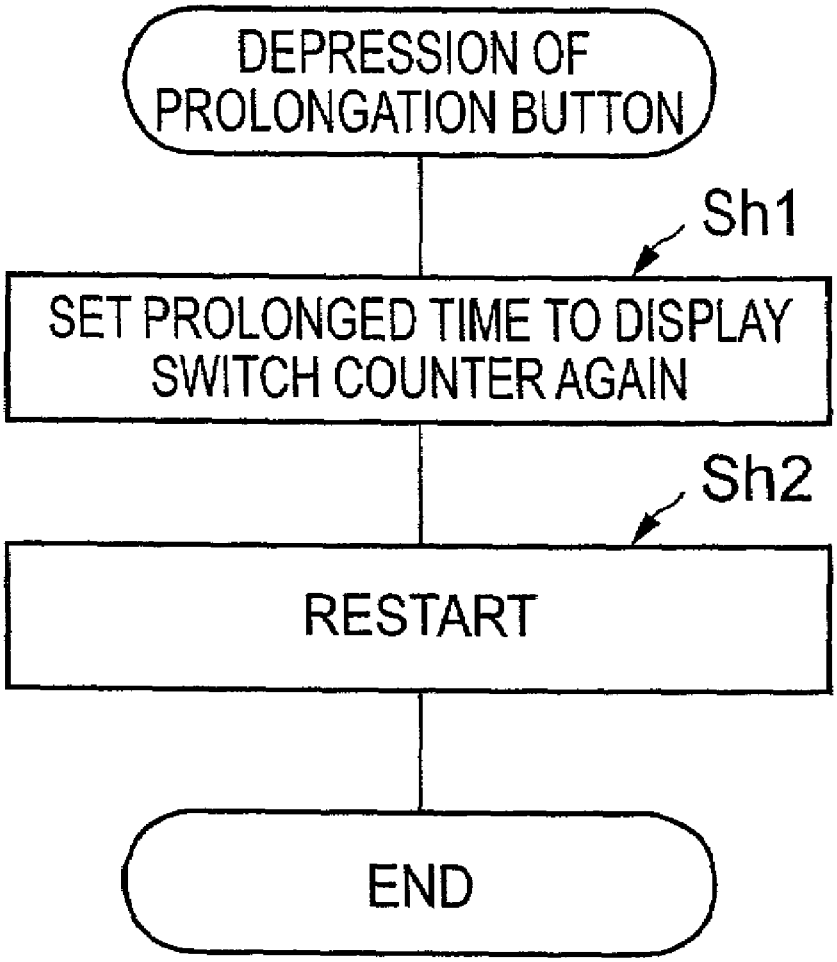
FIG. 17 is a flowchart for explaining a display switching processing of the electronic timepiece of Embodiment 3 according to the invention.

FIG. 17 is a flowchart for explaining a display switching processing of the electronic timepiece of Embodiment 3 according to the invention. Further, in the following processing, the various data are acquired by using the various functions of the electronic timepiece 100 by the user and successively stored to the various data holding portion 123 of the storage medium 120. Further, the display time in accordance with the amount of data is previously set by the user and held in the display time set value holding portion 122.

First, when the user depresses the button 131 for issuing an instruction for displaying the various data, at the central processing portion 110 when the input recognizing means 111 recognizes depression of the button 131, the various data displayed by the switching means 115 is read from the storage medium 120 and the amount of data is calculated. The switching means 115 reads the set value of the display time set value holding portion 122, recognizes setting of the calculated amount of data nd selects the display time to be switched. The switching means 115 transmits the switched display time to the display time controlling means 117 and the displaying means 116. The displaying time controlling means 117 sets the display timer of the display timer counter counting means 118 to the selected display time. The display timer counting means 118 counts the set display time and transmits the timing signal to the displaying means 116 at respective elapse of the display time. The displaying means 116 successively displays the various data to the display portion 140 based on the timing signal. The above-described processing is the same as the processing explained in reference to the flowchart of FIG. 3 in Embodiment 1, mentioned above.

Meanwhile, according to Embodiment 3, when the prolongation switch button is depressed in the above-described processing, the central processing portion 110 sets a prolonged time period to the display switch counter again (step Sh1). For example, in the case in which the prolongation switch button is depressed when the various data are displayed at intervals of 0.5 second, for example, data displayed when the prolongation switch button is depressed is switched to successive data by setting an interval of 3 seconds. That is, the data displayed when the prolongation switch button is depressed is set to fix for 3 seconds. The data displayed when the prolongation switch button is depressed is fixed and switched to successive data when the set time, for example, 3 seconds has elapsed.

Figure 18:
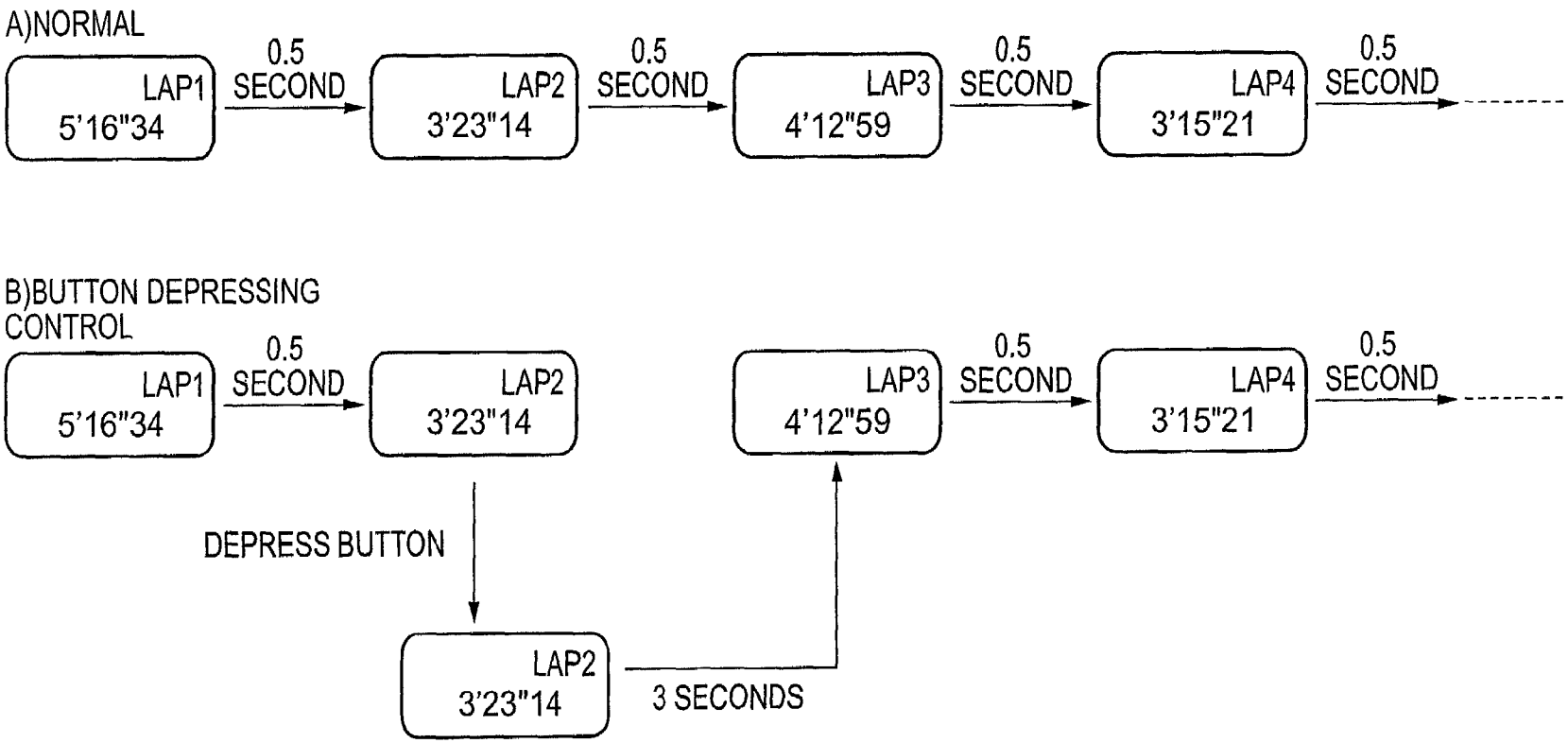
FIG. 18 is a view of transitional change of a display screen for explaining a display switch timing of the electronic timepiece of Embodiment 3 according to the invention.
Figure 19:
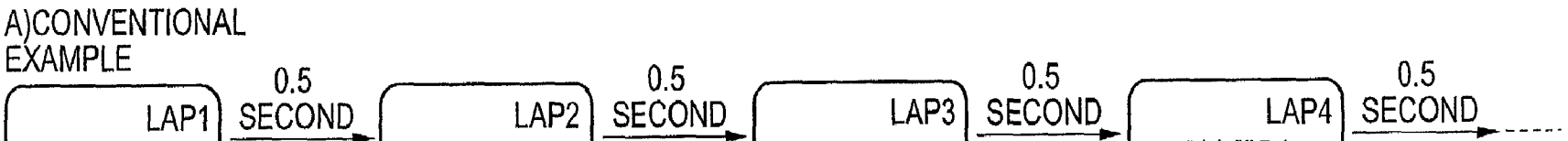
FIG.19 PRIOR ART
FIG. 19 is a view showing transitional change of a display screen for explaining a display switch timing of a conventional electronic timepiece.

Next, an explanation will be given of an example of switching the display screen. FIG. 18 is a view showing a transitional change example of the display screen for explaining the display switch timing of the electronic timepiece of Embodiment 3 according to the invention. As shown by FIG. 18, when lap time is displayed, firstly, the display screen is switched at intervals of 0.5 second and when the prolongation switch button is depressed, the screen displayed when the prolongation switch button is depressed is fixed for 3 seconds. Thereby, attention can be attracted to the data when the user depresses the light button and therefore, there can be executed display in correspondence with operation of confirming the various data by the user.

According to Embodiment 3, mentioned above, a display can be switched in accordance with the amount of data and, therefore, the invention process a display switching method of the electronic timepiece which improves the way of use by the user by displaying to switch the screen in accordance with the amount of data in the state of ensuring the optical recognizability of the user even in the case of a large amount of data as in measured lap time, and provides the electronic timepiece and the display switch program for the electronic timepiece.

Further, although according to Embodiments 1 through 3, mentioned above, an explanation has been given of a case in which the switching means executes a switching operation based on the previously registered reference value, the switching means may be provided with reference total display time calculating means for calculating reference total display time when acquired various data is displayed by being switched by a reference display time in view of a relationship between an amount of the acquired various data and reference display time, total display time comparing means for comparing the reference total display time and longest total display time, and actual display time setting means for setting the reference display time as actual display time when the reference total display time shorter than the longest total display time, selecting display time by which the reference total display time is shorter than the longest total display time, and setting the display time as actual display time when the reference total display time is longer than the longest total display time, and display of the various data to the screen may be switched by the set actual display time.

Further, the switching means may be provided with storing means for previously storing longest total display time by which total time for displaying the various data on the screen becomes the longest, kind name storing means for storing kind name of data displayed with priority among acquired various data to the storage medium, reference total display time calculating means for calculating reference total display time when acquired various data is displayed by being switched by reference display time and the total display time comparing means for comparing the reference total display time and the longest total display time, and picking-up means for picking up data of previously set kind name among acquired various data when the reference total display time is longer than the longest total display time and the picked-up data may successively be displayed.

Further, the kind name storing means may store kind name of data displayed with priority among the acquired various data to the storage medium as newest data, the picking-up means may pick up the data successively from the acquired newest data and the displaying means may display the data successively from the picked-up newest data. Further, the kind name storing means may store a number of the picked-up set data to the storage medium, the picking-up means may pick up an amount of the number of the set data and displaying means may successively display data of the amount of the number of the picked-up set data.

Further, the reference total display time calculating means may calculate reference total display time by calculating a product of an amount of the various data by reference display time, or may previously store a relationship among the amount of the various data, the reference display time and the product of the amount of the various data by the reference display time to the storage medium as data base and may calculate corresponding reference total display time from the data base in accordance with the relationship between the amount of the various data and the reference display time.

Further, there may be provided display time storing means for storing to the storage medium display switch setting time prolonging display time of data of kind name of data displayed with priority among the acquired various data and shortening display time of data other than the kind name of the data displayed with priority among the acquired various data, and the displaying means may prolong display time in the case of the data of the kind name of the data displayed with priority among the acquired various data and shorten display time in the case of data other than the kind name of the data displayed with priority among the acquired various data to thereby attach intensity in display timing.

Further, the displaying means described in Embodiments 1 through 3, mentioned above, may display the data from a first one in an order of acquiring the various data, or display the various data successively from a last one in accordance with the switched display time. Further, the switching means described in Embodiments 1 through 3, mentioned above, may switch the display screen by prolonging or shortening display time for respective various data, or switch the display screen by attaching intensity to display time by changing the length of the display time for respective various data. Further, the switching means may set switching by selecting only predetermined data. In this case, it is preferable that the predetermined data is constituted by data of a kind previously set and there is provided searching and sampling means for searching and sampling data of the set kind in displaying. Further, there may be provided priority storing means for setting a priority to a kind of the set various data and storing the priority to the storage medium and the displaying means may display the various data in accordance with the priority.

Further, there may be provided controlling means for operating means of at least one of light emitting means for making a light emitting element such as a back light of a display, an illumination light or the like emit light, sound outputting means for outputting sound such as buzzer sound, and vibrating means for vibrating an electronic timepiece in parallel with the displaying means. Further, when there are provided a button having two functions of a function of the light emitting means and a function of the displaying means and the user depresses the button with intention of display, the light emitting element may emit light along with display of the various data.

Further, there may further be provided depression recognizing means for recognizing depression of a commanding button provided at an electronic timepiece and the switching means may switch display time in the case of recognizing depression of the commanding button. Further, the switching means may fix a screen of data displayed in depressing the commanding button for a constant period of time and after elapse of the constant time period, may be switched to successive data, or, during the time period of elapse of the constant time period after depressing the commanding button, may prolong, or shorten or switch with intensity, display time of respective various data, or after elapse of the constant time period from depression of the commanding button, may return to switching of display before depressing the commanding button.

As has been explained above, according to the invention, a display can be switched in accordance with an amount of data and, therefore, there is achieved an effect capable of displaying by switching a screen in accordance with an amount of data in an state of ensuring optical recognizability of a user even in the case of a large amount of data as in measured lap time. Therefore, there is achieved an effect of providing a display switching method of an electronic timepiece which improves use by a user, and providing an electronic timepiece and a display switching program for the electronic timepiece.

What is claimed is:

1. A method of switching display of data in an electronic timepiece having a computer for controlling operation of the electronic timepiece, comprising the steps of:

a data storing step of storing in a storage medium of the computer data inputted by a user using functions of the electronic timepiece;

a switching step of switching display time of the data in accordance with an amount of the data stored in the storage medium of the computer; and a displaying step of displaying the data on a screen of the electronic timepiece by successively switching display of the data in accordance with the switched display time.

2. A method of switching display of data in an electronic timepiece according to claim 1; further comprising the steps of setting a reference value corresponding to the amount of the data and storing the reference value in the storage medium of the computer prior to the data storing step; wherein in the switching step, the computer switches the display time in accordance with whether the amount of the data stored in the storage medium is larger or smaller than the reference value.

3. A method of switching display of data in an electronic timepiece according to claim 1; further comprising a display time storing step of storing in the storage medium of the computer the display time of the data and a reference display time of the data; a reference total display time calculating step of calculating a reference total display time in accordance with a relationship between the amount of the data and the reference display time; a total display time comparing step of comparing the reference total display time with a longest total display time of the data; and an actual display time setting step of setting the reference display time as the actual display time when the reference total display time is shorter than the longest total display time, selecting a display time by which the reference total display time becomes shorter than the longest total display time when the reference total display time is longer than the longest total display time, and setting the selected display time as the actual display time; wherein in the switching step, the computer switches to display the data on the screen of the electronic timepiece by the set actual display time.

4. A method of switching display of data in an electronic timepiece according to claim 3; wherein in the reference total display time calculating step, the reference total display time is calculated by calculating a product of the amount of the data and the reference display time, the reference display time and the product of the amount of the data and the reference display time being stored previously in the storage medium as a database capable of being read by the computer; and wherein the computer calculates a corresponding one of the reference total display time from the data base in accordance with the relationship between the amount of the data and the reference display time.

5. A method of switching display of data in an electronic timepiece according to claim 1; further comprising a display time storing step of storing in the storage medium of the computer the display time, a reference display time, and a longest total display time of the data on the screen; a data type storing step of storing in the storage medium the type of the data displayed during the displaying step; a reference total display time calculating step of calculating a reference total display time in accordance with a relationship between the amount of the data and the reference display time; a total display time comparing step of comparing the reference total display time with the longest total display time; and a selecting step of selecting data from the data type stored in the storage medium when the reference total display time is longer than the longest total display time; wherein in the switching step, the computer successively displays the data selected during the selecting step.

6. A method of switching display of data in an electronic timepiece according to claim 5; wherein in the data type storing step, the type of the data displayed is stored in the storage medium as newest data; wherein in the selecting step, the data is selected successively from a newest one of the data; and wherein in the displaying step, the data is displayed successively from the newest one of the selected data.

7. A method of switching display of data in an electronic timepiece according to claim 5; wherein in the data type storing step, the computer stores in the storage medium a number of set data to be selected during the selecting step; wherein in the selecting step, the computer selects an amount of the number of the set data; and wherein in the displaying step, the computer displays successively the selected amount of the set data.

8. A method of switching display of data in an electronic timepiece according to claim 1; wherein in the displaying step, the computer displays the data from a first one of the data in an order of acquiring the data in accordance with the switched display time, or displays the various data successively from a last one of the data.

9. A method of switching display of data in an electronic timepiece according to claim 1; wherein in the switching step, the computer switches the display screen by prolonging or shortening the display time of the respective data, or switches the display screen by attaching an intensity to the display time by changing a length of the display time for respective data.

10. A method of switching display of data in an electronic timepiece according to claim 1; wherein in the switching step, the computer switches the display time of the data by selecting only preselected ones of the data.

11. A method of switching display of data in an electronic timepiece according to claim 1; further comprising at least one of a light emitting step of making a light emitting element emit light, a sound outputting step of outputting sound, or a vibrating step of vibrating the electronic timepiece during the displaying step.

12. A method of switching display of an electronic timepiece according to claim 1; further comprising the step of providing a button in the electronic timepiece having a function of instructing the computer to execute the light emitting step and a function of instructing the computer to execute the displaying step; wherein when the user depresses the button for executing the displaying step, the computer executes the light emitting step along with the displaying step.

13. A method of switching display of data in an electronic timepiece according to claim 1; further comprising a depression recognizing step of recognizing by the computer a depression of a commanding button provided to the electronic timepiece; wherein in the switching step, when the computer recognizes the depression of the commanding button, the computer switches the display time.

14. A program for controlling the computer of the electronic timepiece to execute the steps of the method of switching display of data in the electronic timepiece according to claim 13.

15. A program for controlling the computer of the electronic timepiece to execute the steps of the method of switching display of data in the electronic timepiece according to claim 1.

16. An electronic timepiece comprising:

data storing means for storing in a storage medium of a computer data inputted by a user using various functions of the electronic timepiece;

switching means for switching display time of the data in accordance with an amount of the data stored in the storage medium; and displaying means for displaying the data on a screen of the electronic timepiece by successively switching display of the data in accordance with the switched display time.

17. A method of switching a display of an electronic timepiece having a plurality of functions and a display for displaying data, comprising the steps of:

storing in a storage medium data inputted by a user using the functions of the electronic timepiece;

switching a display time of the data in accordance with an amount of the data stored in the storage medium; and displaying the data on the screen of the electronic timepiece by successively switching display of the data in accordance with the switched display time.

18. A method according to claim 17; wherein switching step includes the step of switching the display time of the data by prolonging or shortening the display time of respective ones of the data.

19. A method according to claim 17; further comprising, during the displaying step, at least one of a light emitting step of emitting light, a sound outputting step of outputting a sound, or a vibrating step of vibrating the electronic timepiece.

20. A method according to claim 17; further comprising the steps of providing a button in the electronic timepiece for executing the light emitting step, and depressing the button to emit light during the displaying step.

* * * * *